US008705767B2

(12) United States Patent
Hiensch

(10) Patent No.: US 8,705,767 B2
(45) Date of Patent: Apr. 22, 2014

(54) ELECTROSTATIC SPEAKER SYSTEM

(75) Inventor: Henk-Albert Hiensch, Velp (NL)

(73) Assignee: Hiensch Innovations B.V. (NL)

( * ) Notice: Subject to any disclaimer, the term of this patent is extended or adjusted under 35 U.S.C. 154(b) by 904 days.

(21) Appl. No.: 12/745,533

(22) PCT Filed: Nov. 29, 2007

(86) PCT No.: PCT/NL2007/050607

§ 371 (c)(1),
(2), (4) Date: May 28, 2010

(87) PCT Pub. No.: WO2009/070004

PCT Pub. Date: Jun. 4, 2009

(65) Prior Publication Data

US 2010/0303263 A1 Dec. 2, 2010

(51) Int. Cl.
*H04R 3/00* (2006.01)

(52) U.S. Cl.
USPC ..... 381/113; 381/111; 381/120; 330/10

(58) Field of Classification Search
USPC ..... 381/190–191, 116, 120, 123, 111, 118; 330/10, 251, 207 A
See application file for complete search history.

(56) References Cited

U.S. PATENT DOCUMENTS 5,218,315 A * 6/1993 Turner ..... 330/10
5,352,986 A 10/1994 Modgil et al.
7,899,197 B2 * 3/2011 Mayazaki ..... 381/116
8,041,059 B2 * 10/2011 Miyazaki ..... 381/191

FOREIGN PATENT DOCUMENTS

WO 2007/081584 A 7/2007

OTHER PUBLICATIONS

International Search Report, in connection with International Application No. PCT/NL2007/050607, mailed Aug. 26, 2008, 2 pages.

* cited by examiner

*Primary Examiner* — Xu Mei
(74) *Attorney, Agent, or Firm* — Meyer IP Law Group

(57) ABSTRACT

The invention relates an electrostatic speaker system comprising—a high voltage switching power amplifier,—an extraction filter having an input coupled to an output of the high voltage switching amplifier, and—an electrostatic speaker element having a capacitive load and an input coupled to an output of the extraction filter. The combination of the extraction filter and capacitive load form a filter circuitry having at least a first filter stage and a second filter stage. The first filter stage comprising a RLC circuit having a resonant frequency ωO and a quality factor Q>½ and wherein the second filter stage being a low pass filter comprises at least one electrical element for damping a signal component at the resonant frequency of the RLC circuit at the output of the extraction filter.

23 Claims, 8 Drawing Sheets

Figure 1:
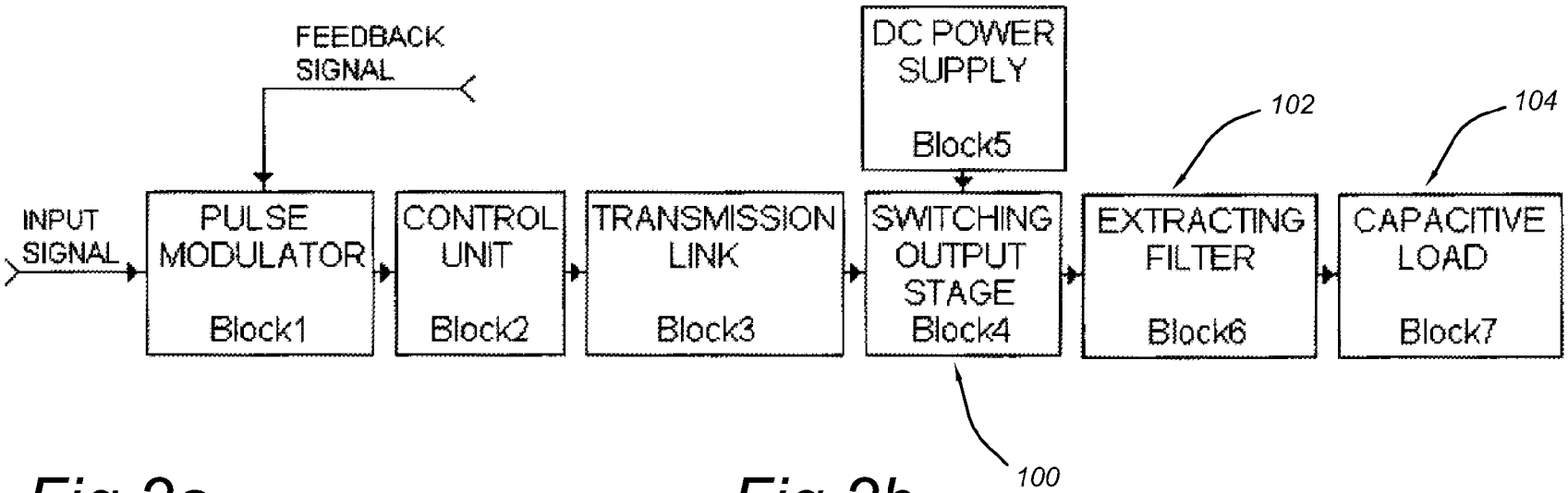

Fig 4 Filter 10a
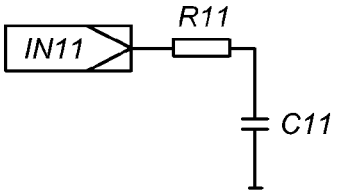
Fig 5 Filter 10b
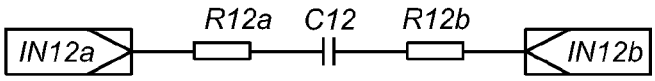
Fig 6 Filter 20a
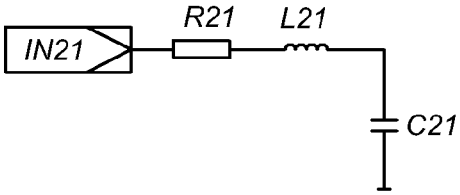
Fig 7 Filter 20b
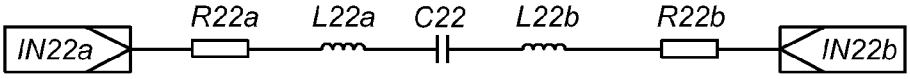
Fig 8 Filter 30a
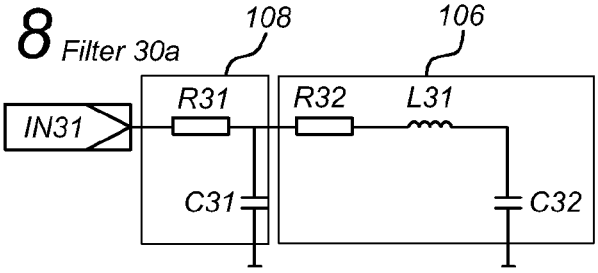
Fig 9 Filter 30b
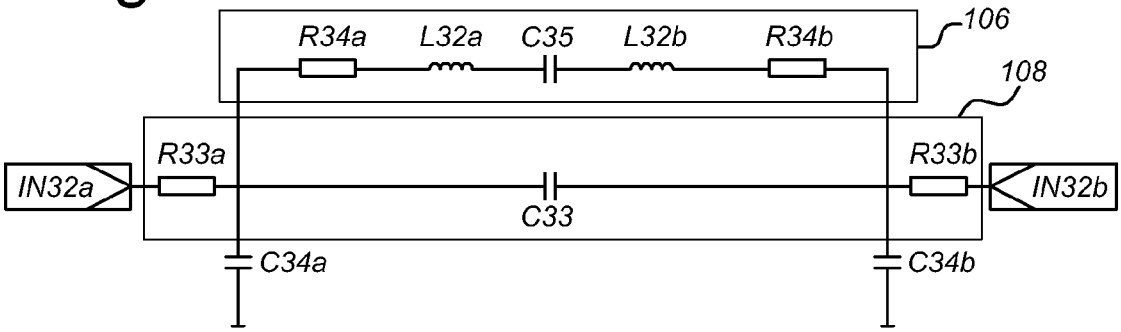

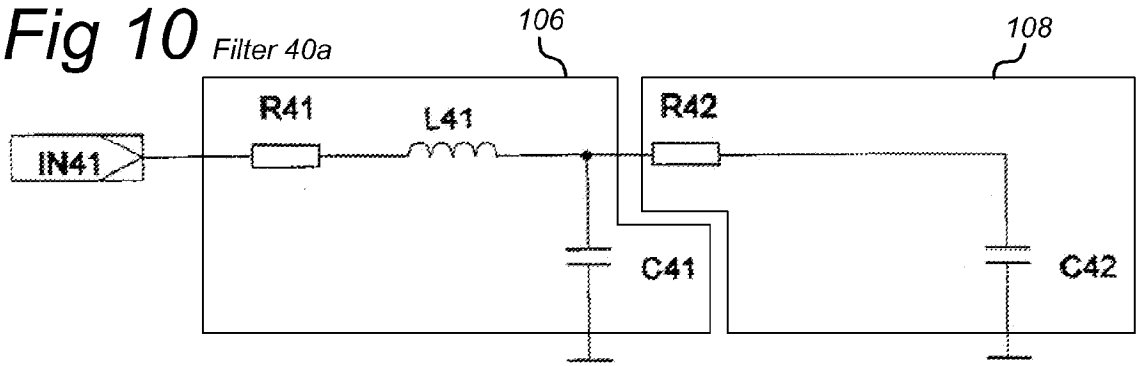
Fig 10 Filter 40a
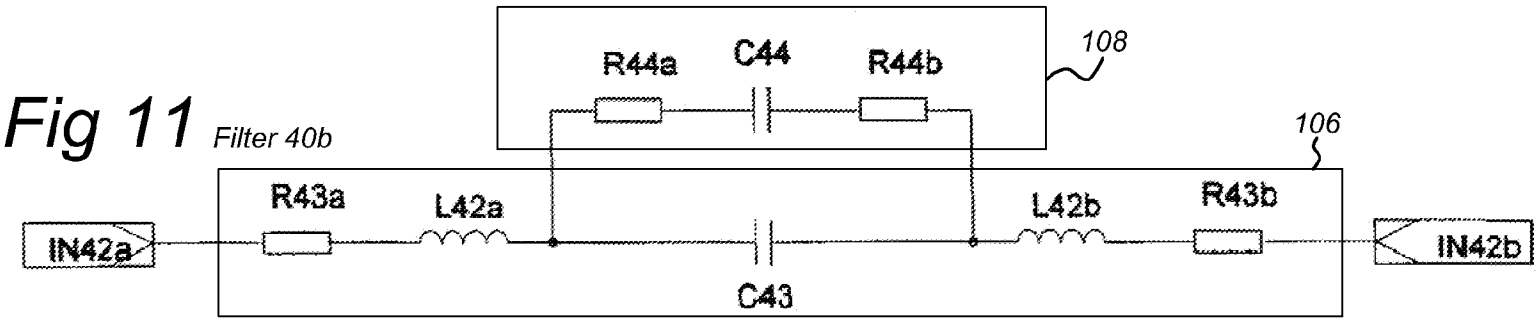
Fig 11 Filter 40b
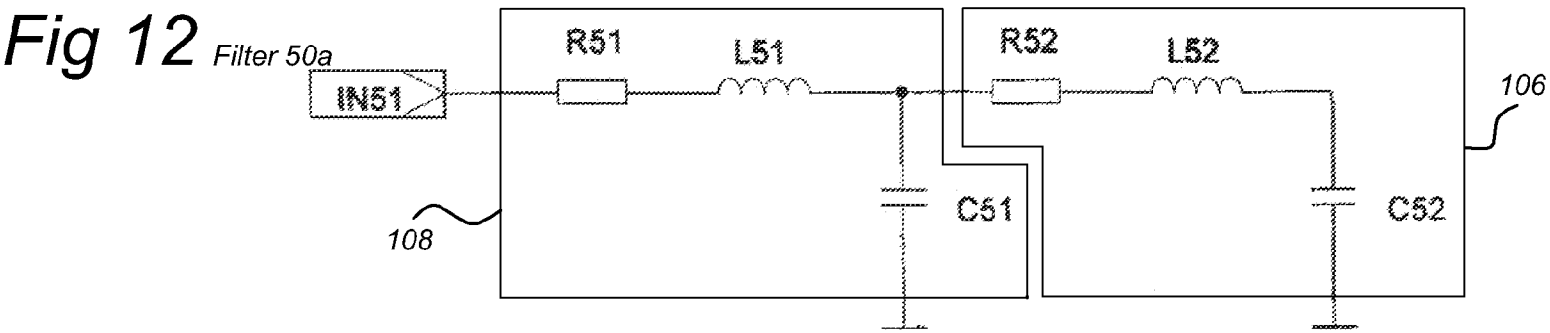
Fig 12 Filter 50a

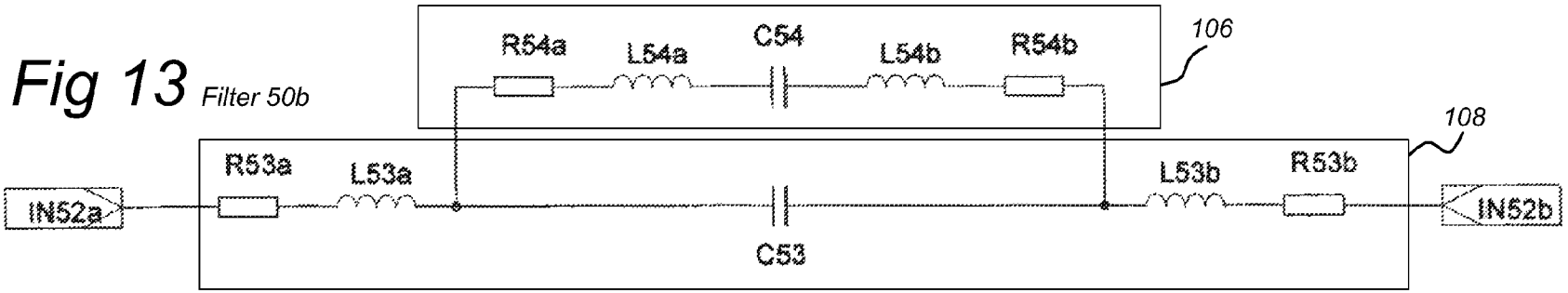
Fig 13 Filter 50b
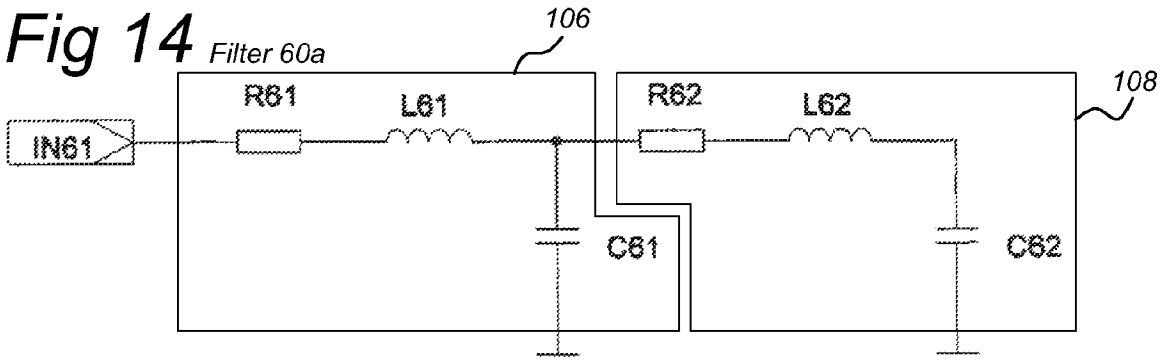
Fig 14 Filter 60a
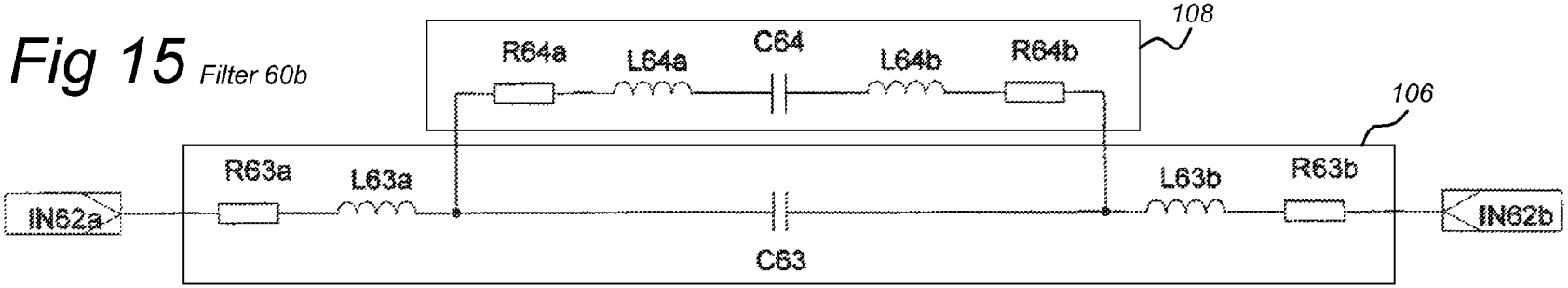
Fig 15 Filter 60b

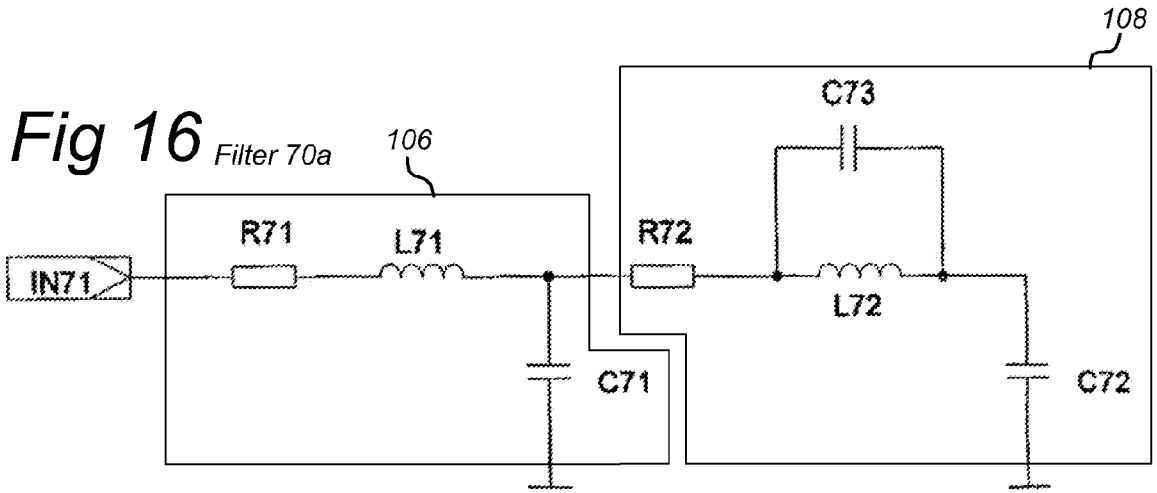
Fig 16 Filter 70a
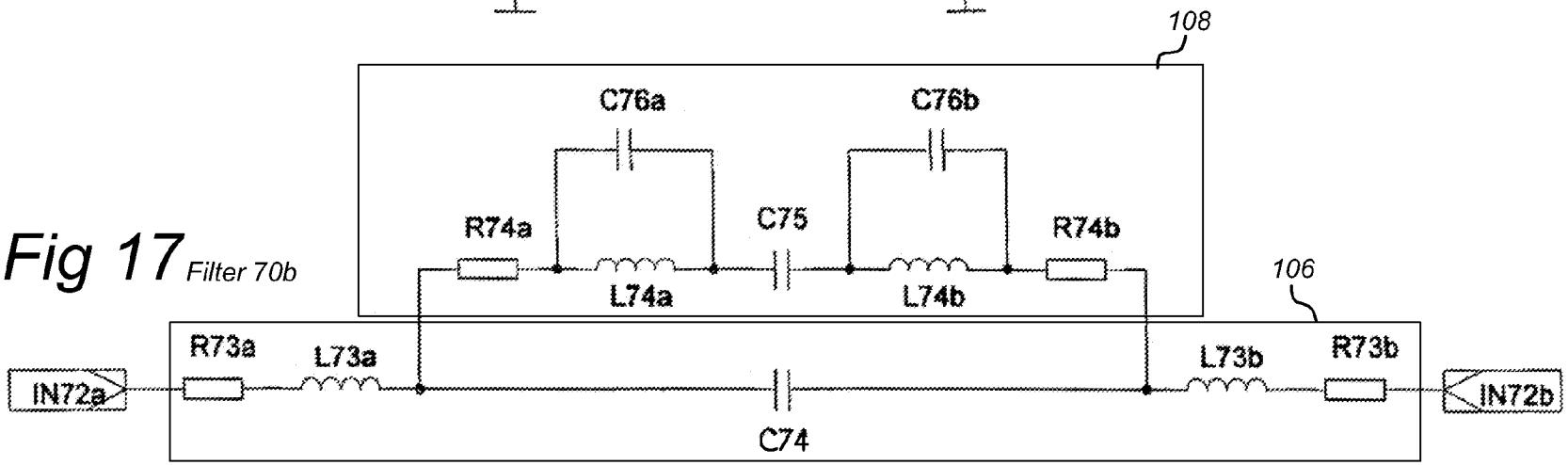
Fig 17 Filter 70b

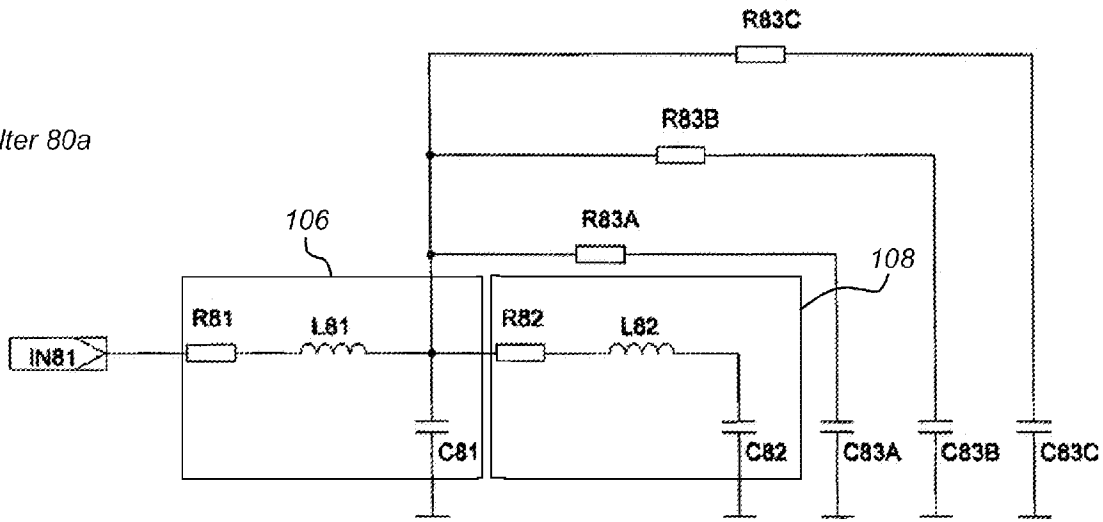
Fig 18 Filter 80a
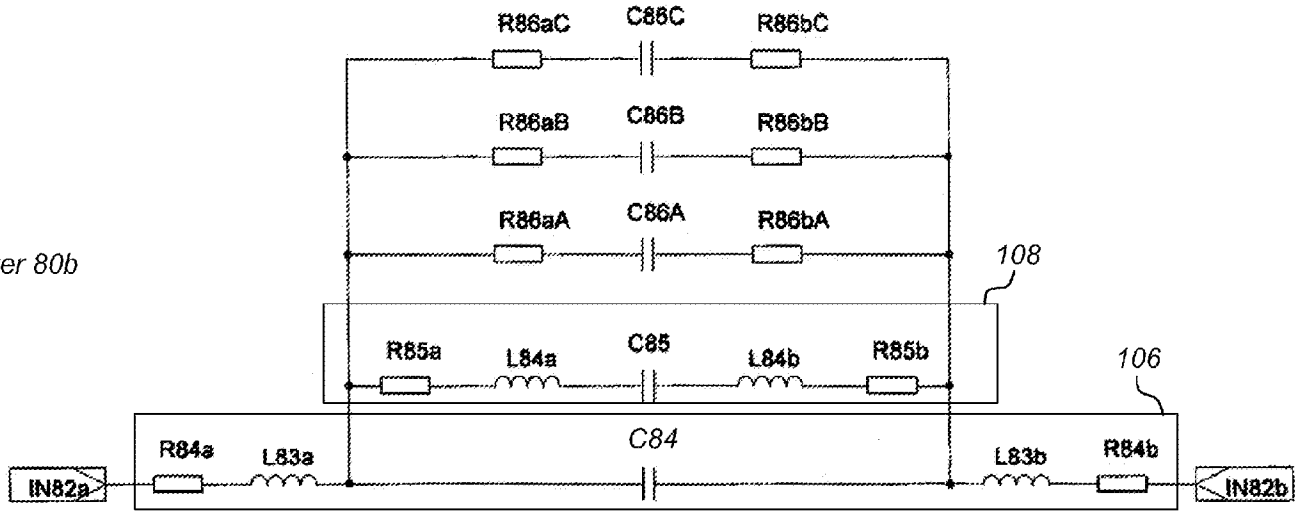
Fig 19 Filter 80b

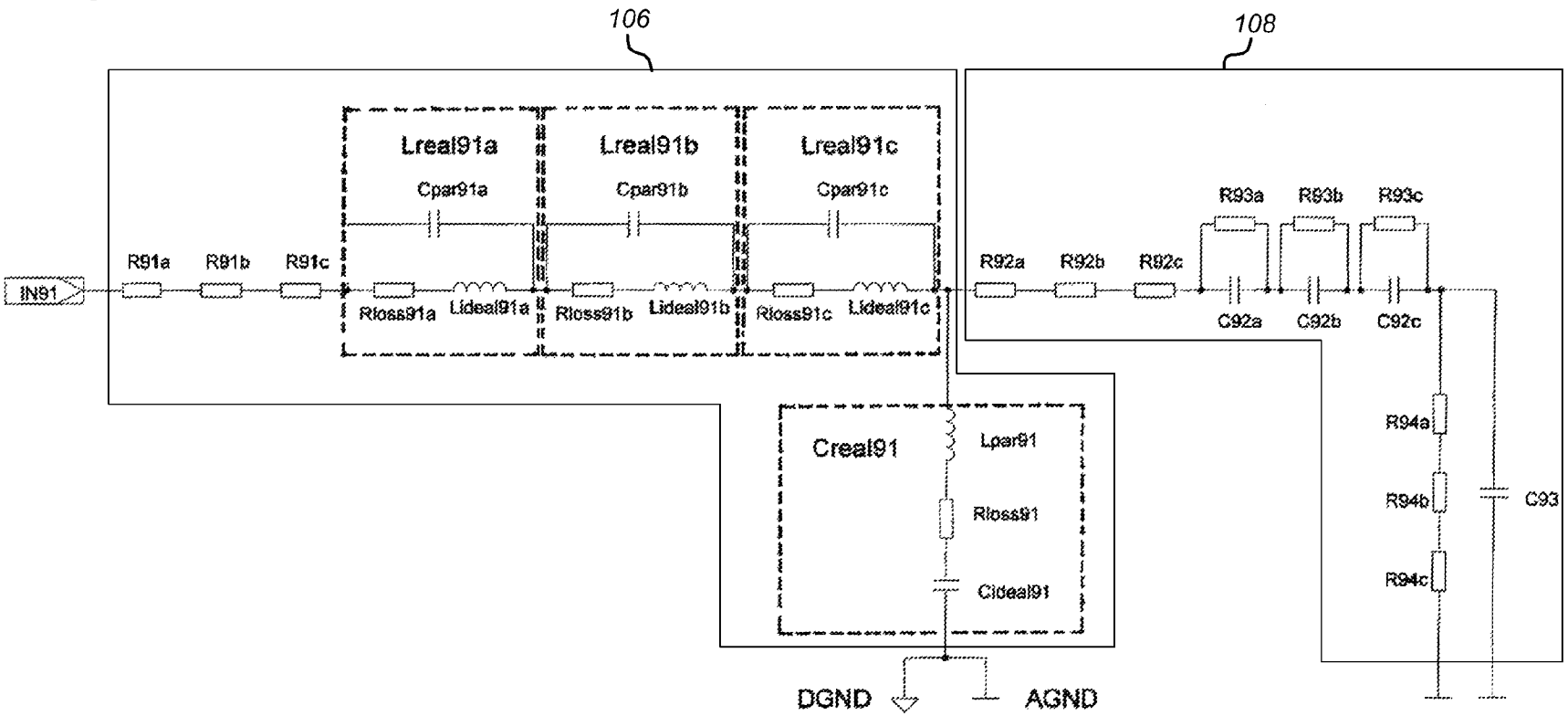
Fig 20 Filter 90

ELECTROSTATIC SPEAKER SYSTEM

FIELD OF THE INVENTION

The invention relates an electrostatic speaker system, and more specifically, to an electrostatic speaker system comprising a pulse modulator, a high voltage switching output stage amplifying the pulse modulated signal and an extraction filter demodulating the amplified pulse modulated high voltage signal, a filter for attenuating high frequencies of the amplified pulse modulated high voltage signal and an electrostatic speaker element coupled to an output of the filter.

DESCRIPTION OF THE RELATED AND PRIOR ART

An electrostatic speaker element utilizes the electrostatic principle in order to generate an acoustic signal. For example, the most common embodiment of an electrostatic speaker element comprises two electrical conductive and perforated plates, also known as the stators and in addition a thin electrical conductive diaphragm disposed between the two stators with on either side a small air gap with respect to the stators. Subsequently the electrical conductive diaphragm will be held on a constant electrical charge with respect to the stators by means of a high DC bias voltage in order to meet the desired electrical field strength. The stators are connected to an AC high voltage analogue signal, in which the stators will be driven in counter phase, also called a "push pull" configuration, resulting in a proportional and uniform electrostatic field between both stators, which generates sufficient field strength in order to cause a force on the electrical charged diaphragm, providing movement of the diaphragm and subsequently the surrounding air. In contrast to the electro dynamic cone speaker, which is a low impedance device, an electrostatic speaker will yield a capacitive load exhibiting a high impedance device.

In order to reproduce an acoustical source signal, a modular system of components may be required, in which each component provides a specific functionality.

In general such a modular system, constituted with an electrostatic speaker system, is made up of the following components, namely,

- An audio reproduction device, such as for example a CD player.
- An audio power amplifier providing gain to an audio signal in order to drive a low impedance device, such as for example an electro dynamic cone speaker.
- An audio power transformer performing the necessary impedance matching in order to drive a high impedance device, namely the capacitive load of an electrostatic speaker element, in which the audio power transformer converts the low AC voltage signal into an AC high voltage analogue signal.
- An electrostatic speaker element driven with the AC high voltage analogue signal derived from the audio power transformer, resulting in for example an alternating electrical field between the stators, in which the electrical charged diaphragm will follow.

The secondary side of an audio power transformer, connected to an electrostatic speaker element, may result in very low and a complex impedance on the primary side of the transformer connected to an audio power amplifier as described above. Therefore the audio power amplifier may not perform well as designed, due to the very low and complex impedance, resulting in increased distortion products and the possibility of instable and perturbing behaviour. As a result a stable and very powerful audio amplifier may be necessary.

The key role of an audio power transformer is to provide a constant transformation ratio over the total operational audio bandwidth. The combination of leak inductance and the parasitic capacitance, arising from the secondary layer windings of a power transformer, in conjunction with the capacitive load of a connected electrostatic speaker element results in a LC low pass filter, which may define the frequency response negatively. The power handling is another limiting factor in the configuration of an audio power transformer, due to a mix of properties. As a result the construction of an audio power transformer is critical, because the necessity for a compromise between the diversity of properties is inevitable. Furthermore the constituted electrostatic speaker element in conjunction with an audio power transformer will be designed towards a standard audio power amplifier, resulting in a narrowed flexibility of design, construction and optimization possibilities. Subsequently it is apparent that an audio power transformer has physical limitations in an approach that allows driving an electrostatic speaker element.

To overcome the deficiencies of driving an electrostatic speaker element with a standard audio power amplifier in conjunction with a power transformer, there can be taken advantage of a high voltage audio power amplifier, which is capable of driving the capacitive load of an electrostatic speaker element directly, without the use of a power transformer. A high voltage audio power amplifier designed in order to drive a capacitive load of an electrostatic speaker element directly, is in principle better than driving an electrostatic speaker element with a standard audio power amplifier in conjunction with a power transformer. A high voltage audio power amplifier may be constituted with the use of semiconductor technology or thermionic valves technology (Vacuum tubes).

The diversity of semi-conductor based active components, such as for example a Bipolar Junction Transistor (BJT), a Metal Oxide Semiconductor Field Effect Transistor (MOSFET) or an Insulated Gate Bipolar Junction Transistor (IGBT), can be connected in series in order to meet the desired AC high voltage output signal, in which the bridged voltage may be divided equally across the constituted semiconductors. A high voltage audio power amplifier, designed with the use of class-A/B technology, has two basic flaws namely bias current adjustment and power dissipation. In order to reduce cross over distortion employing class-A/B technology, bias current adjustment will be required, in which the optimum will be achieved in a class-A setting. As a result of an increasing bias current in order to reduce cross over distortion, the power dissipation will increase accordingly. Subsequently a class-A setting will be difficult to obtain in an embodiment of a high voltage audio power amplifier, because of the resulting heavy power requirements. In addition, by employing a complex load, such as the capacitive load of an electrostatic speaker element, the power dissipation will increase further as well as the possibility of instable behaviour. Therefore this concept has no optimum, which implicates a compromise.

Another option in order to constitute a high voltage audio power amplifier is the use of thermionic valves technology (vacuum tubes) as mentioned above. In general, employing thermionic valves technology has additional drawbacks with respect to semi-conductor technology as described above, such as for example the sensitivity for ageing and the relatively poor reliability.

As described above, the diversity of prior art amplification techniques have much in common related to the driving capability of a capacitive load, namely, Feedback and a high bias current are necessary in order to aim at a linear transfer;

Stability is limited by employing a capacitive load;

Very low energy efficiency;

Further increase of power dissipation by employing a capacitive load;

High variance of temperature and therefore a shift of parameters;

Expensive due to a high energetic power supply and cooling means.

A switching audio amplifier also called a pulse modulation amplifier and more specific called for example a pulse width modulation amplifier or a class-D amplifier, forms, with respect to energy efficiency and the interrelated subjects, an exception to the low voltage amplification concepts capable of driving a low impedance device, such as for example an electro dynamic cone speaker as described above. The concept of a switching amplifier may achieve an efficiency of 90% and higher, which is inherent to the principle. WO00072627 A1 discloses a switching amplifier driving a capacitive transducer.

SUMMARY OF THE INVENTION

According to the above stated deficiencies that exist with prior art arrangements, the objective of the present invention is to provide an improved electrostatic speaker system, which is capable of driving a capacitive load of an electrostatic speaker element directly showing a high level of quality in sound reproduction.

According to the present invention, the electrostatic speaker system comprises:

a high voltage switching power amplifier, an extraction filter having an input coupled to an output of the high voltage switching amplifier, and an electrostatic speaker element having a capacitive load and an input coupled to an output of the extraction filter, wherein the combination of the extraction filter and capacitive load form a filter circuitry having at least a first filter stage and a second filter stage, the first filter stage comprising a RLC circuit having a resonant frequency $\omega 0$ and a quality factor $Q>1/2$ and the second filter stage being a low pass filter having at least one electrical element for damping a signal component at the resonant frequency $\omega 0$ of the RLC circuit at the output of the extraction filter.

The present invention provides a system of driving the capacitive load of an electrostatic speaker element directly allowing a wide operational bandwidth with a flat frequency response, stability, reliability, flexibility, and a very energy efficient concept, in which the amplified analogue AC high voltage signal can be processed very precise obtaining high fidelity. Furthermore the approach of the present invention allowing a very energy efficient concept may result in a low energetic power supply, less cooling means and therefore smaller enclosing means and in addition a low temperature variance resulting in a low shift of parameters and a long life cycle of the resided components.

The objective of the invention is a well designed extraction filter obtained in accordance with the presented methods, circuitry, equations and components in the manner described later, in which the extraction filter may act as a passive integrator, provided that the frequency of the pulse modulated switching signal presented at the input of the extraction filter is at least an order of magnitude higher with respect to the operational bandwidth of the extraction filter. Subsequently the analogue AC output signal, defined within the operation bandwidth of the extraction filter, is equal to the average value of the pulse modulated switching input signal, wherein the amplified analogue AC output signal will be the proportional replica of the analogue source signal. The capacitive load of an electrostatic speaker element, connected to the output of the extraction filter, will form an integral part of the extraction filter configuration in order to obtain an approach that allows in the frequency domain as well as in the signal domain a wide operational bandwidth with a flat frequency response, a narrow filter roll-off with sufficient attenuation of the switching frequency and its harmonics, good impulse response, stable, in which the analogue signal will be reconstructed very precise.

Furthermore the invention provides an approach of segmenting an electrostatic speaker element electrically in conjunction with an extraction filter and therefore providing a technique that allows adapting the electrostatic speaker element acoustically.

Further embodiments of the invention are indicated by the dependent claims.

Based on the discussion given in the present invention, the open loop characteristics of a high voltage switching power amplifier, connected to the capacitive load of an electrostatic speaker element, may be very good in order to obtain a high level of quality in sound reproduction. This novel approach of the preferred embodiment will be achieved by means of a highly alleviated and subsequently very stable high voltage power supply providing high resolution voltage levels and therefore exhibiting very low Total Harmonic Distortion (THD) characteristics, obtained in accordance with an employed high impedance device as a load, the implemented high efficient switching topology, and a high reactive power component inherent to a capacitive load, in which the reactive energy may be regenerated in conjunction with the extraction filter and the high voltage DC power supply. In addition very fast switching of the high voltage switching output stage may be accomplished with a minimum of dead time by means of driving a high impedance device, in which the high impedance device will comprise an extraction filter including the capacitive load. Furthermore a well designed extraction filter may conduce to very good open loop characteristics of the preferred high voltage switching power amplifier. As a result the present invention provides a digital front end high voltage switching power amplifier driving the capacitive load of an electrostatic speaker element, without the use of any feedback means.

In general a designer, employing the present invention, is provided with the flexibility in choosing the various operating topologies as will be presented hereinafter in order to match the desired parameters of an electrostatic speaker setting. Subsequently it is to be noted that an embodiment of a high voltage switching power amplifier in the scope of the present invention is capable of operating at various high voltage levels in conjunction with various power levels, at various performance levels, with various pulse modulation techniques in conjunction with various analogues and digital input formats, with various output stage switching topologies, and with various extraction filter configurations.

SHORT DESCRIPTION OF DRAWINGS

Figure 2A:
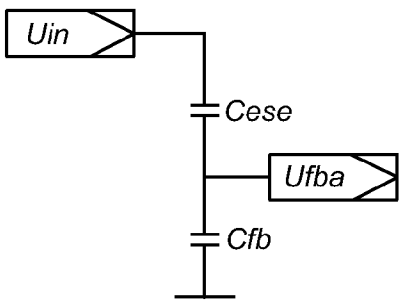
Figure 2B:
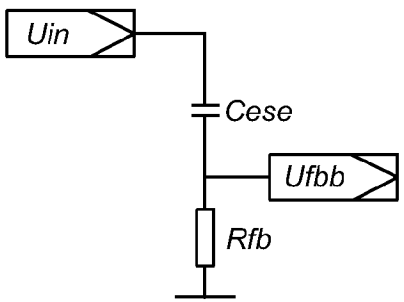
Figure 3A:
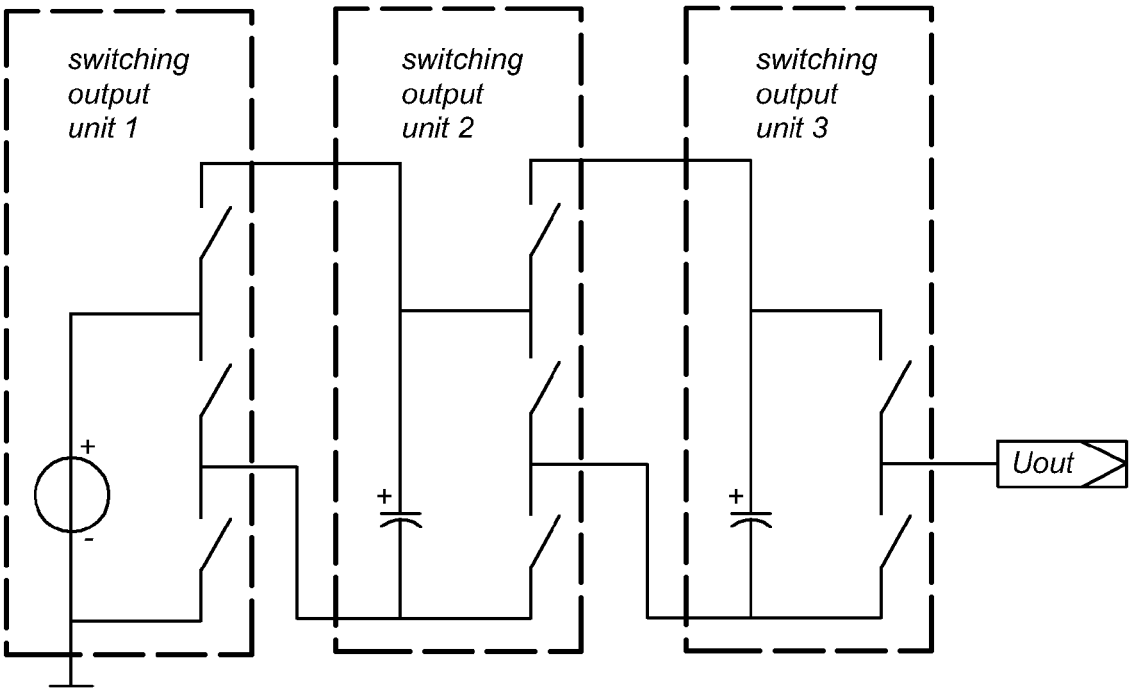
Fig 3a Prior Art
Figure 3B:
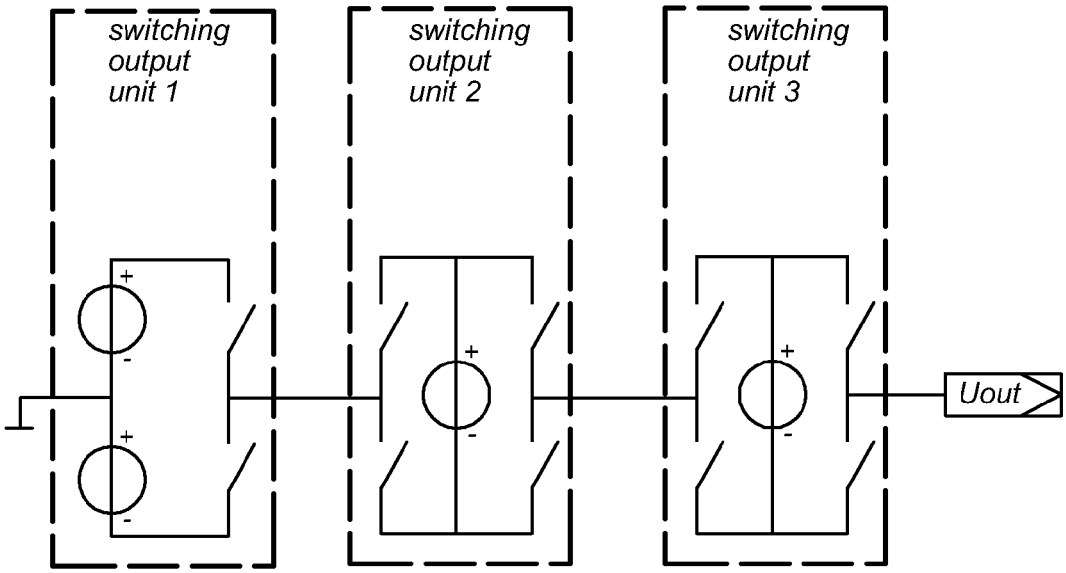
Fig 3b Prior Art

The present invention will be discussed in more detail below, using a number of exemplary embodiments, with reference to the attached drawings that are intended to illustrate the invention but not to limit its scope which is defined by the annexed claims and its equivalent embodiment, in which FIG. 1 illustrates a conceptual block diagram of an electrostatic speaker system according to the invention, FIG. 2*a* illustrates an electrical circuit diagram of a voltage feedback signal, FIG. 2*b* illustrates an electrical circuit diagram of a current feedback signal, FIG. 3*a* illustrates the circuit configuration of a gradient switching power topology, FIG. 3*b* illustrates the circuit configuration of a more complex gradient switching power topology, FIG. 4 illustrates a simple passive single ended low pass first order filter, FIG. 5 illustrates a passive differential low pass first order filter, FIG. 6 illustrates a single ended low pass second order filter, FIG. 7 illustrates a differential low pass second order filter, FIG. 8 illustrates a single ended low pass third order filter, FIG. 9 illustrates a differential low pass third order filter, FIG. 10 illustrates a single ended low pass third order filter in another form, FIG. 11 illustrates a differential low pass third order filter in another form, FIG. 12 illustrates a single ended low pass fourth order filter, FIG. 13 illustrates a differential low pass fourth order filter, FIG. 14 illustrates the preferred single ended extraction filter embodiment, FIG. 15 illustrates the preferred differential extraction filter embodiment, FIG. 16 illustrates the preferred single ended extraction filter supplemented with a parallel resonant filter, FIG. 17 illustrates the preferred differential extraction filter supplemented with two parallel resonant filters, FIG. 18 illustrates the preferred single ended extraction filter supplemented with one or several further low pass filters being parallel connected to the main second filter stage, FIG. 19 illustrates the preferred differential extraction filter supplemented with one or several further low pass filters being parallel connected to the main second filter stage, and FIG. 20 illustrates a more practical circuit configuration of a single ended band pass filter comprising a high pass first order filter in conjunction with a low pass third order filter.

DETAILED DESCRIPTION OF EXEMPLARY EMBODIMENTS

A basic conceptual block structure of an electrostatic speaker system is shown in FIG. 1, comprising a pulse modulator (Block 1), a control unit (Block 2), a transmission link (Block 3), a high voltage switching output stage (Block 4), a high voltage DC power supply (Block 5), an extraction filter (Block 6) and a capacitive load (Block 7).

The invention provides an embodiment that may receive one or several analogue audio signals as well as digital audio signals as an input, emanated from for example a pre-amplifier or an audio reproduction device, such as a CD player, and connected to a pulse modulator FIG. 1: Block 1. The digital audio signal can be in any suitable digital audio format such as: SPDIF, AAC, DTS, Quicktime, WMA, MP3.

For example, a pulse modulator and more specific a Pulse Width Modulator (PWM) is provided with an analogue audio formatted input signal and a reference triangular signal, in which the frequency of the reference triangular signal is at least an order of magnitude higher with respect to the operational bandwidth of the analogue audio formatted input signal. Subsequently the pulse width modulator will convert the analogue audio formatted input signal, by comparison of the analogue input signal with the reference triangular signal in an analogue way, into a pulse width modulated signal exhibiting a fundamental equal to the triangular signal frequency, in which the average value of the pulse modulated signal will be the equivalent of the analogue audio formatted input signal.

The pulse modulation technique is not limited to straight pulse width modulation as described in an example above and includes other pulse modulation means optimized for audio applications, such as an analogue or digital pulse modulator employing a multi-bit pulse modulated topology as will be described below in more detail. A pulse modulation topology FIG. 1: Block 1 may be configured for compensating the characteristic corresponding to a feedback signal, which feeds back the condition of for example the switching output stage in order to obviate distortion due to timing errors.

The capacitive load of an electrostatic speaker element may provide feedback to a pulse modulation topology as well, based on voltage feedback as well as current feedback.

As illustrated in FIG. 2*a*, an input terminal Uin may receive a ground referenced AC high voltage analogue signal and is connected to the capacitive load Cese of an electrostatic speaker element that is series connected to a ground referenced capacitor Cfb providing a ground referenced voltage feedback signal Ufba, in which the capacitive load Cese will form a capacitive voltage divider with respect to a much higher capacitance valued capacitor Cfb in order to set a proper feedback ratio. As illustrated in FIG. 2*b*, an input terminal Uin may receive a ground referenced AC high voltage analogue signal and is connected to the capacitive load Cese of an electrostatic speaker element that is series connected to a ground referenced resistor Rfb providing a ground referenced current feedback signal Ufbb, in which the feedback signal Ufbb will be the equivalent ratio of the current flowing through the capacitive load Cese.

It is to be noted, that the designer, employing the invention, is provided with the flexibility in choosing the various pulse modulation topologies, such as for example sigma delta modulation, self oscillating class D modulation or a digital modulator like Equibit from Texas Instruments and class Z from Zetex. Furthermore the various pulse modulation topologies may be combined in conjunction with feed forward means as well as feedback means implemented in the analogue domain as well as in the digital domain.

An electrostatic speaker system according to the invention could optionally comprise a control unit Block 2 implementing for example a delay timing control and a limiter function, due to the practical limitations of the components constituted in a switching power topology. In general a delay timing control will adjust the timing of the pulse modulated signal generated by the modulator, in which the adjusted time, called dead time, avoids cross conduction during transition in the switching output stage. Furthermore the pulse width of the pulse modulated signal can be limited to be within an acceptable minimum pulse width by means of a limiter function in order to obtain save operation of the switching output stage.

The control unit Block 2 is not limited to the examples of the feed forward control methods as described above and could include other control means, such as feedback means, which eliminates errors resulting in a more efficient and reliable operation of the electrostatic speaker system.

In general a switching power topology exhibits a circuit configuration of one or several switching elements, wherein these switching elements may be floating with respect to each other as well as other enclosed components including a ground reference. Subsequently there may be taken advantage of one or several galvanically decoupled transmission links as shown in FIG. 1: Block 3 for each switching element in order to drive the constituted switching elements maintaining the floating properties. For example a galvanically decoupled transmission link may comprise a transmitter, constituted of a light emitting diode with an enclosed driver circuit, provided with a one-bit digital signal as an input, wherein the transmitter may be connected by means of an optic cable to a suitable receiver, such as a phototransistor enclosed in an driver circuit. Subsequently the receiver will be capable of driving a switching element in either a conductive or in a blocked condition corresponding to the one-bit digital input signal.

The galvanically decoupled transmission technique used is not limited to the example of a data transmission link as described above and could include other galvanic separation means, such as an integrated opto-isolator or a transformer, which are optimized for high speed in conjunction with high voltage operation. It is to be noted that the accuracy of the galvanically decoupled driver arrangement will be very important to the end system performance.

It is desired to employ a gradient switching topology as a switching power output stage Block 4 in order to provide a stable and reliable method capable of generating a high voltage switching output signal. The high voltage switching output signal could have an output voltage on the order of magnitude from a few hundred up to a few thousand volts and will exhibit in addition high efficiency, which is inherent to the principle. In general a gradient switching power topology exhibits a well known method by one skilled in the art, wherein a number of cascaded switching output units will result in a switching output voltage, which may be the sum of voltages generated by the number of the switching output units, in which each switching output unit by itself may have a predetermined switching output voltage. By determining the output voltage of a switching output unit as well as selecting the number of the cascade connected switching output units, the desired maximum switching output voltage of a gradient switching output stage can be easily obtained.

The switching power output stage implemented with a gradient switching power topology will enclose two or several switching output units, in which an output unit will comprise a plurality of switching elements, wherein a switching element may be any suitable type of semiconductor, such as for example a Metal Oxide Semiconductor Field Effect Transistor (MOSFET) or a Bipolar Junction Transistor (BJT) in conjunction with a clamp diode. Furthermore each switching output unit will comprise a DC power supply which may be constituted of for example one suitable capacitor or more in parallel.

It is to be noted, that a gradient switching power topology can be implemented in various circuit configurations, of which two exemplary constituted circuits are shown in FIG. 3*a* and FIG. 3*b*. As illustrated in FIG. 3*a* the circuit configuration of a gradient switching power topology will provide a switching output voltage equal to the summed voltages of the switching output units with respect to ground. Furthermore, the second and following DC power supplies of the cascaded switching output units will be charged by the main and initial DC power supply of the first switching output unit connected to ground. In the case a switching output signal without a DC voltage component is required with respect to ground, decoupling can be implemented by means of for example a DC blocking capacitor or a DC bias voltage. Referring to FIG. 3*b* the circuit configuration of a more complex gradient switching power topology is shown providing a switching output signal without a DC voltage offset component with respect to ground. In addition each switching output unit may be implemented with a characteristic switching output voltage by means of an adapted DC power supply voltage.

In the case a gradient switching arrangement is constituted in a modular form in contradiction to an integrated approach, each implemented module can provide a switching output unit as described above supplemented with for example connector means as well as enclosure means and cooling means resulting in increased system versatility in choosing for example the desired switching output voltage or the resolution in voltage output steps by selecting the number of the switching output modules cascaded in a stacked form. Furthermore increased system versatility by means of a modular design may allow optimum cost to performance ratios with respect to the production of a high voltage switching amplifier.

It is to be noted, that each switching output unit of a gradient switching arrangement, separate and yet interrelated multi-bit pulse modulated control schemes may be implemented, in order to provide a combination of switching output voltages and currents at different levels, in which each switching output unit independently of one another can be switched at different times and frequencies, provided that the switching frequency of at least one switching output unit is at least an order of magnitude higher with respect to the analogue operational signal bandwidth. A gradient switching arrangement employing multi-bit pulse modulated control schemes as described above may be used for example to optimize filtering performance in order to enhance extracting a high voltage analogue signal from the multi-bit pulse modulated high voltage switching signal.

The gradient switching power topologies according to the exemplary circuit configurations shown in FIG. 3*a* and FIG. 3*b* illustrate a half bridge topology.

However in other presented embodiments of the invention a full bridge or H bridge topology will be employed as well, in which two gradient switching arrangements are set on opposite sites of one another as described below in more detail.

The gradient switching power topology used in the preferred embodiment of the invention is not limited to the exemplary circuit configurations of the two gradient switching arrangements as described above and includes other switching topology means, such as for example the most elementary well known switching half-bridge and full-bridge topologies, which are optimized for a well shaped block wave output signal and high voltage operation.

Considering the capacitive load of a high voltage power amplifier, the handled apparent power may consist of a dominant reactive power part over the real power part as will be described below in more detail. Subsequently it is an objective of a well designed high DC voltage power supply, indicated in FIG. 1 by Block 5, to handle the apparent power in order to drive the capacitive load of an electrostatic speaker element maintaining an accurate and stable DC voltage under varying load conditions, in which the high DC voltage of the power supply will obviate inter-modulation with the block wave output signal of the switching output stage and therefore the related analogue output signal to a desired minimum, which may result in very good total harmonic distortion (THD) characteristics even in an open loop setting in accordance with an employed high impedance device as a load, the constituted high efficient switching topology, and a high reactive power component inherent to a capacitive load.

A DC power supply deriving energy from the AC mains may be implemented by means of well-known design topologies such as for example a bridge rectifier in conjunction with one stabilizing capacitor or more in parallel or a switched mode power supply (SMPS).

In the case of a DC power supply, in which the DC voltage can be adjusted between zero and the maximum voltage, a main volume analogue output signal control will be obtained. Hence an analogue or digital audio formatted inputs signal maintaining maximum signal resolution throughout the circuitry of the high voltage switching power amplifier. As a result, small signal amplification will be improved, noise will be reduced and a further increase of efficiency will be obtained, with respect to for example regular main volume control of an analogue or digital audio formatted signal at the input of a high voltage switching power amplifier.

An objective of the invention is a well designed extraction filter, indicated in FIG. 1 by Block 6. Below some examples of extraction filter topologies will be described and the method how to derive the optimal component values for the respective extraction filter topologies. The presented methods, circuitry, equations and components enables a skilled person in the art to obtain an extraction filter that will exhibit two primary filtering requirements described hereinafter which provides in the frequency domain as well as in the signal domain a wide operational bandwidth with a flat frequency response, a narrow filter roll-off with sufficient attenuation of the switching frequency and its harmonics, a good impulse response, a stable filter, in which the analogue signal will be reconstructed very precise. It is to be noted, that the characteristic capacitive load of an electrostatic speaker element, indicated in FIG. 1 by Block 7, that is connected to the output of the extraction filter, will form an integral part of the extraction filter configuration in order to obtain the above stated objectives and will present in addition the starting point in extraction filter calculation. Therefore in the following description Block 6 and Block 7 are discussed simultaneously.

According to the first requirement, the extraction filter will be forced to act as a passive integrator, provided that the frequency of the generated high voltage switching output signal, typically between 250 kHz to 1.5 MHz, presented at the input of the extraction filter is at least an order of magnitude higher, typical a ratio factor between 5 and 10, with respect to the operational bandwidth of the extraction filter. Subsequently the analogue output signal, defined within the operation bandwidth of the extraction filter, is equal to the average value of the pulse modulated switching input signal, wherein the amplified analogue output signal will be the proportional replica of the analogue source signal.

According to the second requirement, the extraction filter will be forced to minimize electromagnetic interference (EMI), generated by the high voltage switching output stage. In general a high voltage output stage will provide a high voltage as well as a high frequency block wave signal with fast moving transient edges containing spectral energy at the switching frequency in conjunction with the integer multiples of the fundamental. As a result, an extraction filter is required, in which the switching frequency and its harmonics of the high voltage switching signal will be sufficient attenuated in order to minimize EMI from being radiated as well as conducted and in addition to guarantee compliance with applicable regulations.

For example Spread spectrum modulation can be employed in conjunction with an extraction filter in order to obtain proper EMI performance. In general spread spectrum modulation is obtained by dithering or randomizing the fundamental of a pulse modulated signal, rather than a fixed pulse modulated signal frequency. As a result the total amount of energy present in the frequency output spectrum of the extraction filter will remain the same employing spread spectrum modulation, but the total spectral energy is effectively spread out over a wider bandwidth and therefore not concentrated at a fixed switching frequency and its harmonics.

In general it is an objective to minimize electrical energy from being dissipated in the preferred extraction filter embodiment of the present invention. Furthermore the preferred extraction filter embodiment depends on various design issues in order to match the desired parameters, such as for example the design and construction of an electrostatic speaker element or the format of the pulse modulated signal that is being processed as will be covered by the present invention.

According to the basic construction of an electrostatic speaker element, comprising two electrical conductive and perforated stators and in addition a thin electrical conductive diaphragm disposed between the two stators with on either side a small air gap with respect to the stators, the resided capacitive load of an electrostatic speaker element may be implemented in a single ended extraction filter configuration employing a half bridge switching topology as well as in a differential extraction filter configuration employing a full bridge switching topology. It is to be emphasised, that an employed differential extraction filter will be implemented symmetrical with respect to the capacitive load of an electrostatic speaker element in order to maintain the balance in the reversibly operating differential extraction filter.

In the case a single ended configuration is implemented, a half bridge switching topology will be used in conjunction with a single ended extraction filter, wherein the output of the single ended filter is connected to the electrical conductive diaphragm of the electrostatic speaker element. Furthermore both stators of the electrostatic speaker element are provided with a constant electrical charge complementing each other (a positive and a negative charge) with respect to the electrical conductive diaphragm. Subsequently the capacitive load of an electrostatic speaker element, implemented in a single ended configuration consists between the electrical conductive diaphragm and the two AC short circuited stators on either side of the diaphragm of the element.

In an alternative embodiment of an electrostatic speaker element, provided with a constant electrical charged diaphragm with respect to the stators, one of either stators may be driven in a single ended configuration with the other stator connected to for example a common DC reference voltage, in which the capacitive load will consist between the two stators of the element.

However in another embodiment, a full bridge or H bridge switching topology may be employed in which two half bridge topologies are set on opposite sites of one another in order to drive the capacitive load of an electrostatic speaker element differentially by means of a differential extraction filter. In general the most elementary full bridge switching topology generates two block wave signals complementing each other, which results in an alternating differential voltage across the differential extraction filter providing twice the output voltage swing with respect to a half bridge topology employing the same supply voltage.

In the case a differential configuration is implemented, a full bridge switching topology will be used in conjunction with a differential extraction filter exhibiting a "push pull" configuration, wherein the output of the differential extraction filter is connected to the stators of the electrostatic speaker element. Furthermore the diaphragm of the electrostatic speaker element is provided with a constant electrical charge with respect to the stators. Subsequently the capacitive load of an electrostatic speaker element, implemented in a differential configuration consists between the stators of the element.

According to a single ended configuration as well as a differential configuration as described above each driving for example the capacitive load of an identical basic electrostatic speaker element, the resided capacitive load presented in a single ended configuration will be four times as heavy as the capacitive load resided in a differential configuration. As a result a basic electrostatic speaker element implemented in a single ended configuration requires one quarter of an employed analogue high voltage swing with respect to an identical electrostatic speaker element implemented in a differential configuration in order to generate an equal amount of electrical charge and subsequently equal electrical field strength.

It is to be noted, that a half bridge or a full bridge topology comprising a DC voltage offset component, due to for example a single supply voltage, than this DC voltage offset component can be obviated by means of for example a DC-blocking capacitor, a positive and negative supply voltage or a DC bias voltage, if an AC high voltage analogue signal without a DC voltage offset component is required, for example in conjunction with a common reference voltage implemented in a electrostatic speaker element. Similarly with the half bridge topology comprising a DC voltage offset component, the full bridge topology will have a DC voltage offset component on each side of the capacitive load with respect to a common reference voltage.

The diaphragm area of an electrostatic speaker element may be acoustically adapted by means of segmenting the diaphragm area into two or several segments, depending on the design and construction of the element in order to provide for example a wider disbursement of sound waves, in particular within the high frequency audible range. The approach that allows segmenting a diaphragm area acoustically can be obtained by segmenting one or both stators as well as the electrical conductive diaphragm area electrically. As a result each segment comprises a characteristic capacitance which will form the capacitive component employed in an extraction filter embodiment as described below in more detail. Needless to say that the segmentation technique implemented in an electrostatic speaker element may be employed in conjunction with a single ended configuration as well as a differential configuration as described above.

It is to be noted, that an electrostatic speaker element by itself may be interpreted as a segment as well with respect to for example another electrostatic speaker element. Furthermore the segmenting technique in order to adapt the operational bandwidth in whole or in part is not limited to an electrostatic speaker element and may include other audio projecting components, such as an electro dynamic cone speaker element. Nonetheless in the case an electrostatic speaker element is segmented in multiple sections in order to adapt the electrostatic speaker element acoustically, providing for example signal filter means or signal delay means, each segmented section by itself may be driven by a high voltage switching power amplifier, in which each of the multiple high voltage switching power amplifiers may be provided with an adapted analogue or digital formatted signal as an input distributed by an analogue or digital processing units enclosed in for example a pre-amplifier topology.

The following extraction filter embodiments of the present invention will now be described more specifically. It is to be emphasised, that the following descriptions of the present invention, with reference to the extraction filter embodiments, are presented herein for purpose of illustration and description only, in which the precise forms disclosed are not intended to be exhaustive or to be limited. Furthermore the extraction filter embodiments of the present invention resides not only in any filter configuration taken alone, but rather in the particular combination of all of its structures as well as all of its interrelationships for the functions specified.

FIG. 4 illustrates the circuit diagram of single ended low pass filter 10*a* exhibiting a simple passive first order filter.

As shown in FIG. 4, the low pass filter 10*a* configuration may receive a high voltage pulse modulated signal provided at input terminal IN11 with respect to ground, wherein the filter 10*a* stage comprises a series connection of resistor R11 and capacitor C11, the series connection connected between the input terminal IN11 and a ground node. The constituted capacitor C11 in the low pass filter 10*a* configuration represents the capacitive load of an electrostatic speaker element.

Ideally the roll-off of the first order low pass filter 10*a* setting provides an attenuation of 20 dB per decade after the cut-off frequency. The cut-off frequency expressed in radiant of filter 10*a* is $$\omega_{filter10a} = \frac{1}{R_{11}C_{11}} \tag{E1}$$

The output impedance of filter 10*a* is defined in accordance with the following $$Z_{filter10a}(s) = \frac{R_{11}}{1 + sR_{11}C_{11}} \tag{E2}$$

and the transfer function of filter 10*a* is defined as $$H_{filter10a}(s) = \frac{1}{1 + sR_{11}C_{11}} \tag{E3}$$

FIG. 5 illustrates the circuit diagram of differential low pass filter 10*b* exhibiting a passive first order filter.

As shown in FIG. 5, the low pass filter 10*b* configuration may receive a high voltage pulse modulated signal provided at input terminal IN12*a* with respect to a complemented high voltage pulse modulated signal provided at input terminal IN12*b*, wherein the filter 10*b* stage comprises a series connection of the first resistor R12*a*, capacitor C12 and the second resistor R12*b*, the series connection connected between the first input terminal IN12*a* and the second input terminal IN12*b*. The constituted capacitor C12 in the low pass filter 10*b* configuration represents the capacitive load of an electrostatic speaker element.

The differential filter 10*b* setting exhibits the equivalent model of the single ended filter 10*a* setting, which is implemented in another form. In order to match the filter characteristics of both the single ended filter 10*a* setting and the differential filter 10*b* setting, the resistance of resistor R11 is divided by 2, and assigned to the resistors R12*a* and R12*b*.

For example, if the resistor value of resistor R11 is calculated to be 10 kOhm, then resistor R12*a* is set to 5 kOhm and resistor R12*b* is set to 5 kOhm. Finally the capacitance of capacitor C11 is equal to the capacitance of capacitor C12 representing the specified capacitive load.

The single ended filter 10*a* setting and the equivalent differential filter 10*b* setting are unconditionally stable, and may be employed for example in conjunction with other passive filter means of higher order as well as segmenting means. However, the single ended filter 10*a* and differential filter 10*b* configuration may not provide the extraction filter performance achieving the two stated primary filtering requirements as described above.

FIG. 6 illustrates the circuit diagram of single ended low pass filter 20*a* exhibiting a passive second order RLC filter.

As shown in FIG. 6, the low pass filter 20*a* configuration may receive a high voltage pulse modulated signal provided at input terminal IN21 with respect to ground, wherein the filter 20*a* stage comprises a series connection of resistor R21, inductor L21 and capacitor C21, the series connection connected between the input terminal 1N21 and a ground node. The constituted capacitor C21 in the low pass filter 20*a* configuration represents the capacitive load of an electrostatic speaker element.

Ideally the roll-off of the low pass second order filter 20*a* setting provides an attenuation of 40 dB per decade after the cut-off frequency. The damped resonance frequency expressed in radiant of filter 20*a* is $$\omega_{filter20a} = \sqrt{\frac{1}{L_{21}C_{21}} - \frac{R_{21}^2}{2L_{21}^2}} \tag{E4}$$

The output impedance of filter 20*a* is defined in accordance with the following $$Z_{filter20a}(s) = \frac{R_{21} + sL_{21}}{1 + sC_{21}R_{21} + s^2L_{21}C_{21}} \tag{E5}$$

and the transfer function of filter 20*a* is defined as $$H_{filter20a}(s) = \frac{1}{1 + sR_{21}C_{21} + s^2L_{21}C_{21}} \tag{E6}$$

FIG. 7 illustrates the circuit diagram of differential low pass filter 20*b* exhibiting a passive second order RLC filter. In the description, the term resonant frequency corresponds to the undamped resonance or natural frequency $\omega_0$ of an RLC circuit and damped resonance frequency is a frequency derived from the natural frequency and the damping factor of a RLC circuit.

As shown in FIG. 7, the low pass filter 20*b* configuration may receive a high voltage pulse modulated signal provided at input terminal IN22*a* with respect to a complemented high voltage pulse modulated signal provided at input terminal IN22*b*, wherein the filter 20*b* stage comprises a series connection of the first resistor R22*a*, the first inductor L22*a*, capacitor C22, the second inductor L22*b* and the second resistor R22*b*, the series connection connected between the first input terminal IN22*a* and the second input terminal IN22*b*. The constituted capacitor C22 in the low pass filter 20*b* configuration represents the capacitive load of an electrostatic speaker element.

The differential filter 20*b* setting exhibits the equivalent model of the single ended filter 20*a* setting, which is implemented in another form. In order to match the filter characteristics of both the single ended filter 20*a* setting and the differential filter 20*b* setting, the resistance of resistor R21 is divided by 2, and assigned to the resistors R22*a* and R22*b*. Furthermore the inductance of inductor L21 is divided by 2 and assigned to the inductors L22*a* and L22*b*, and finally the capacitance of capacitor C21 is equal to the capacitance of capacitor C22 representing the specified capacitive load.

In the case a single ended filter 20*a* setting is employed, one of the critical factors, involved in designing a stable functioning extraction filter, is the attenuation characteristics at the resonant frequency. In order to meet the optimum attenuation characteristics of a low pass filter 20*a* setting and subsequently the specified optimum damping requirement, the resonant frequency in radiant defined by equation E4 is set to zero, in which peaking of the attenuation characteristics at the resonant frequency will be obviated. The specified optimum damping requirement presents a well balanced condition, in which a filter 20*a* setting is just yet stable preventing perturbed behaviour and on the other hand preserving a minimum of attenuation in order to provide a low pass filter 20*a* setting with an operational bandwidth as wide and a frequency response as flat as possible.

If the damped resonance frequency $\omega_d$ in radiant defined by equation E4 is set to zero, then equation E4 can be rewritten in more general terms in accordance with the following $$\frac{R}{\sqrt{2}\,L} = \frac{1}{\sqrt{LC}} \tag{E7}$$

wherein R is the resistance, L is the inductance and C the capacitance.

Rearranging equation E7 may result in the following expression on the condition that the damped resonance frequency $\omega_d$ in radiant defined by equation E4 is set to zero $$\frac{\sqrt{2}}{RC} = \frac{1}{\sqrt{LC}} \tag{E8}$$

If equation E8 is solved for R, in which R is the optimum damping resistance value, then R can be expressed in accordance with the following $$R = \sqrt{2}\sqrt{\frac{L}{C}} \tag{E9}$$

The quality factor Q of a damped second order filter as shown in the filter 20*a* setting can be defined in more general terms in accordance with the following $$Q = \frac{\sqrt{\frac{L}{C}}}{R} \tag{E10}$$

Substituting expression E9 into expression E10 defining R, in which the damped resonance frequency will be set to zero as described above, and solved for Q, than Q is equal to the following result $$Q = \frac{1}{\sqrt{2}} \tag{E11}$$

FIG. 8 illustrates the circuit diagram of single ended extraction filter 30*a*, which exhibits a passive low pass third order filter, constituted of a second filter stage and a first filter stage. The second filter stage comprises a RC filter and the first filter stage comprises a RLC circuit. The component value setting of extraction filter 30*a* and subsequently the derived differential filter 30*b* setting as described hereinafter will be implemented from the point of view of sufficiently damping the signal component at the resonant frequency emanated from the under damped first filter stage by means of the constituted damping components resided in the second filter stage.

As shown in FIG. 8, the low pass filter 30*a* configuration may receive a high voltage pulse modulated signal provided at input terminal IN31 with respect to ground, wherein a second filter stage of filter 30*a* comprises a series connection of a second stage resistor R31 and a second stage capacitor C31, the series connection connected between a second stage input terminal IN31 and a ground node, and wherein a first filter stage of filter 30*a* comprises a series connection of a first stage resistor R32, a first stage inductor L31 and a first stage capacitor C32, the series connection connected between the second stage input terminal and a ground node, a node between the second stage resistor R31 and the second stage capacitor C31 is coupled to an output node of the second filter stage, the output node is coupled to the first stage input terminal of the first filter stage. The constituted first stage capacitor C32 in the low pass filter 30*a* configuration represents the capacitive load of an electrostatic speaker element.

Ideally the roll-off of the low pass third order filter 30*a* setting provides an attenuation of 60 dB per decade after the second cut-off frequency. The output impedance of filter 30*a* is defined in accordance with the following $$Z_{filter30a}(s) = \frac{R_{31} + R_{32} + sL_{31} + sR_{31}R_{32}C_{31} + s^2R_{31}L_{31}C_{31}}{1 + sR_{31}C_{31} + sR_{31}C_{32} + sR_{32}C_{32} + s^2R_{31}R_{32}C_{31}C_{32} + s^2L_{31}C_{32} + s^3R_{31}L_{31}C_{32}C_{31}} \quad \text{(E12)}$$

and the transfer function of filter 30*a* is defined as $$H_{filter30a}(s) = \frac{1}{1 + sR_{31}C_{31} + sR_{31}C_{32} + sR_{32}C_{32} + s^2R_{31}R_{32}C_{31}C_{32} + s^2L_{31}C_{32} + s^3R_{31}L_{31}C_{32}C_{31}} \quad \text{(E13)}$$

FIG. 9 illustrates the circuit diagram of differential extraction filter 30*b*, which exhibits a passive low pass third order filter.

As shown in FIG. 9, the low pass filter 30*b* configuration may receive a high voltage pulse modulated signal provided at input terminal IN32*a* with respect to a complemented high voltage pulse modulated signal provided at input terminal IN32*b*, wherein a second filter stage of filter 30*b* comprises a series connection of a first second stage resistor R33*a*, a second stage capacitor C33 and a second second stage resistor R33*b*, the series connection connected between the first second stage input terminal IN32*a* and the second second stage input terminal IN32*b*, a first filter stage of filter 30*b* stage comprises a series connection of a first stage resistor R34*a*, a first first stage inductor L32*a*, a first stage capacitor C35, a second first stage inductor L32*b* and a second first stage resistor R34*b*, the series connection connected between a first first stage terminal and a second first stage terminal, a node between the first second stage resistor R33*a* and the second stage capacitor C33 is coupled to a first output node of the second filter stage of filter 30*b* and a node between the second second stage resistor R33*b* and the second stage capacitor C33 is coupled to a second output node of the second filter stage, the first output node of the second filter stage is coupled to the first stage terminal and the second output node of the second filter stage is coupled to the second first stage terminal, furthermore the capacitor C34*a* is connected between the first output node and a ground node, the capacitor C34*b* is connected between the second output node and a ground node. The constituted first stage capacitor C35 in the low pass filter 30*b* configuration represents the capacitive load of an electrostatic speaker element.

The differential filter 30*b* setting excluding the capacitors C34*a* and C34*b* exhibits the equivalent model of the single ended filter 30*a* setting, which is implemented in another form.

Similarly the differential filter 30*b* setting excluding capacitor C33 exhibits the equivalent model of the single ended filter 30*a* setting as well. Subsequently the differential low pass filter 30*b* configuration may be implemented by means of a single capacitor C33 excluding the capacitors C34*a* and C34*b*, which forms the preferred configuration, by means of the capacitors C34*a* and C34*b* referenced to a DC voltage or ground node excluding capacitor C33 or by means of a combination of the capacitors C33, C34*a* and C34*b*. In order to match the filter characteristics of both the single ended filter 30*a* setting and the differential filter 30*b* setting, the resistance of resistor R31 is divided by 2 and assigned to the resistors R33*a* and R33*b*, and the resistance of resistor R32 is divided by 2 and assigned to the resistors R34*a* and R34*b*, furthermore the inductance of inductor L31 is divided by 2 and assigned to the inductors L32*a* and L32*b*. In the case capacitor C33 is implemented excluding the capacitors C34*a* and C34*b*, than the capacitance of capacitor C31 is equal to the capacitance of capacitor C33. Implementing the capacitors C34*a* and C34*b* in the low pass differential filter 30*a* configuration excluding capacitor C33, than the capacitance of capacitor C31 is multiplied by 2 and assigned to the capacitors C34*a* and C34*b*. Finally the capacitance of capacitor C32 is equal to the capacitance of capacitor C35 representing the specified capacitive load.

In the case a single ended filter 30*a* setting is employed, one of the critical factors, involved in designing a stable functioning filter, is to obtain the proper ratio between the capacitance values of capacitor C31 and capacitor C32 in conjunction with the proper damping resistance of the resistors R31 and R32 in order to meet the optimum attenuation characteristics. In order to obtain the optimum low pass filter 30*a* setting with an operational bandwidth as wide and a frequency response as flat as possible, it is desired to eliminate resistor R32 in the filter 30*a* configuration. However, due to the practical limitations of inductor L31*a* small resistance value will remain, in which resistor R32 may represent the internal DC resistance of inductor L31. As a result the low pass filter 30*a* configuration becomes a good approximation to the optimum low pass filter 30*a* setting. Therefore, without compromising the results, resistor R32 constituted in the low pass filter 30*a* configuration will be ignored in the following equations and descriptions disclosed until further notice.

In order to meet the optimum damping requirement the resistance value of resistor R31 is set equal to the characteristic impedance of the RLC circuit comprising inductor L31 and capacitor C32 in conjunction with capacitor C31 as can be expressed in accordance with the following $$R_{31} = \sqrt{\frac{L_{31}}{C_{32} - \frac{C_{31}C_s}{C_{31} + C_{32}}}} \quad \text{(E14)}$$

wherein the capacitance value Cs represents the equivalent value of capacitor C31 series connected to capacitor C32 as can be expressed as $$C_s = \frac{C_{31}C_{32}}{C_{31} + C_{32}} \quad \text{(E15)}$$

The proper ratio between the capacitance values of capacitor C31 and capacitor C32 can be obtained by means of equation E8, in which equation E8 may be rewritten in order to meet the low pass filter 30*a* setting according to the following equation $$\frac{\sqrt{2}}{R_{31}(C_{31} + C_{32})} = \frac{1}{\sqrt{L_{31}C_{32}}} \quad \text{(E16)}$$

If the proper ratio between the capacitance values of capacitor C31 and capacitor C32 is expressed in a ratio factor n than the capacitance value of capacitor C32 may be set equal to the following expression $$C_{32}=nC_{31} \quad \text{(E17)}$$

Substituting expression E14 and E17 into equation E16 results in the following equation $$\frac{\sqrt{2}}{\sqrt{\frac{L_{31}}{nC_{31} - \frac{C_{31}\frac{C_{31}nC_{31}}{C_{31} + nC_{31}}}{C_{31} + nC_{31}}}}(C_{31} + nC_{31})} = \frac{1}{\sqrt{L_{31}nC_{31}}} \quad \text{(E18)}$$

If equation E18 is solved for n, in which n is the optimal ratio factor in conjunction with the optimal damping resistance resided in expression E14 as described above, than n is equal to the following rounded result $$n=2.7540 \quad \text{(E19)}$$

and subsequently expression E17 can be written as $$C_{32}=2.7540C_{31} \quad \text{(E20)}$$

In Order to Obtain the Desired Impulse Response of the Filter 30*a* Setting, the quality factor Q may be adjusted by means of resistor R32 yielding a lower quality factor Q with increasing resistance of resistor R32. The relationship between the resistance of resistor R32 and the quality factor Q can be expressed in accordance with the following $$R_{32} = \left(\frac{1}{Q} - \sqrt{2}\right)\sqrt{\frac{L_{31}}{C_{32}}} \quad \text{(E21)}$$

-continued $$\left\{Q \le \frac{1}{\sqrt{2}}\right\}$$

The single ended filter 30*a* setting and the equivalent differential filter 30*b* setting provide an approach that allows a stable extraction filter obtaining a wider operational bandwidth with a flat frequency response in conjunction with improved roll-off characteristics with respect to the above described extraction filter embodiments.

FIG. 10 illustrates the circuit diagram of single ended extraction filter 40*a*, which exhibits a passive low pass third order filter, constituted of a first filter stage and a second filter stage. The first filter stage comprising a RLC circuit and the second filter stage comprising a RC circuit. The component value setting of extraction filter 40*a* and subsequently the derived differential filter 40*b* setting as described hereinafter will be implemented from the point of view of damping the signal component at the resonant frequency emanated from the under damped first filter stage by means of the constituted damping components resided in the second filter stage.

As shown in FIG. 10, the low pass filter 40*a* configuration may receive a high voltage pulse modulated signal provided at input terminal 1N41 with respect to ground, wherein a first filter stage 106 of filter 40*a* comprises a series connection of a first stage resistor R41, a first stage inductor L41 and a first stage capacitor C41, the series connection connected between a first stage input terminal IN41 and a ground node, and wherein the second filter stage of filter 40*a* comprises a series connection of a second stage resistor R42 and a second stage capacitor C42, the series connection connected between a second stage input terminal and a ground node, a node between the first stage inductor L41 and the first stage capacitor C41 is coupled to an output node of the first filter stage, the output node is coupled to the second stage input terminal of the second filter stage. The constituted second stage capacitor C42 in the low pass filter 40*a* configuration represents the capacitive load of an electrostatic speaker element.

Ideally the roll-off of the low pass third order filter 40*a* setting provides an attenuation of 60 dB per decade after the second cut-off frequency. The output function of filter 40*a* is defined in accordance with the following $$\begin{aligned} Z_{filter40a}(s)=&(R_{41}+R_{42}+sL_{41}+sR_{41}R_{42}C_{41}+\\ &s^2R_{42}L_{41}C_{41})(1+sR_{41}C_{42}+sR_{42}C_{42}+\\ &s^2R_{41}R_{42}C_{41}C_{42}+s^2L_{41}C_{41}+s^2L_{41}C_{41}+s^2L_{41}C_{42}+\\ &s^3R_{42}L_{41}C_{41}C_{42}) \end{aligned} \quad \text{(E22)}$$

and the transfer function of filter 40*a* is defined as $$\begin{aligned} H_{filter40a}(s)=&1/(1+sR_{41}C_{41}+sR_{41}C_{42}+sR_{42}C_{42}+\\ &s^2R_{41}R_{42}C_{41}C_{42}+s^2L_{41}C_{41}+s^2L_{41}C_{42}+\\ &s^3R_{42}L_{41}C_{41}C_{42}) \end{aligned} \quad \text{(E23)}$$

FIG. 11 illustrates the circuit diagram of differential extraction filter 40*b*, which exhibits a passive low pass third order filter.

as Shown in FIG. 11, the Low Pass Filter 40B Configuration May Receive a High voltage pulse modulated signal provided at input terminal IN42*a* with respect to a complemented high voltage pulse modulated signal provided at input terminal IN42*b*, wherein a first filter stage 106 of filter 40*b* comprises a series connection of a first first stage resistor R43*a*, a first first stage inductor L42*a*, a first stage capacitor C43, a second first stage inductor L42*b* and a second first stage resistor R43*b*, the series connection connected between a first first stage input terminal IN42*a* and a second first stage input terminal IN42*b*, a second filter stage of filter 40*b* stage comprises a series connection of a first second stage resistor R44*a*, a second stage capacitor C44 and a second second stage resistor R44*b*, the series connection connected between a first second stage input terminal and a second second stage input terminal, a node between the first first stage inductor L42*a* and the first stage capacitor C43 is coupled to a first output node of the first filter stage 106 and a node between the second first stage inductor L42*b* and the first stage capacitor C43 is coupled to a second output node of the first filter stage 106, the first output node is coupled to the first second stage input terminal and the second output node is coupled to the second second stage input terminal. The constituted second stage capacitor C44 in the low pass filter 40*b* configuration represents the capacitive load of an electrostatic speaker element.

The differential filter 40*b* setting exhibits the equivalent model of the single ended filter 40*a* setting, which is implemented in another form. In order to match the filter characteristics of both the single ended filter 40*a* setting and the differential filter 40*b* setting, the resistance of resistor R41 is divided by 2 and assigned to the resistors R43*a* and R43*b*, the resistance of resistor R42 is divided by 2 and assigned to the resistors R44*a* and R44*b*, furthermore the inductance of inductor L41 is divided by 2 and assigned to the inductors L42*a* and L42*b*, the capacitance of capacitor C43 is equal to the capacitance of capacitor C41 and finally the capacitance of capacitor C42 is equal to the capacitance of capacitor C44 representing the specified capacitive load.

In the case a single ended filter 40*a* setting is employed, it is emphasised to obtain the proper ratio between the capacitance values of capacitor C41 and capacitor C42 in conjunction with the proper damping resistance of the resistors R41 and R42 in order to meet the optimum attenuation characteristics. In order to obtain the optimum low pass filter 40*a* setting with an operational bandwidth as wide and a frequency response as flat as possible, it is desired to eliminate resistor R41 in the extraction filter 40*a* configuration. However, due to the practical limitations of inductor L41*a* small resistance value will remain, in which resistor R41 may represent the internal DC resistance of inductor L41. As a result the low pass filter 40*a* configuration becomes a good approximation to the optimum low pass filter 40*a* setting. Therefore, without compromising the results, resistor R41 constituted in the low pass filter 40*a* configuration will be ignored in the following equations and descriptions disclosed until further notice.

In order to meet the optimum damping requirement the resistance value of resistor R42 is set equal to the characteristic impedance of the RLC circuit comprising inductor L41 and capacitor C41 as can be expressed in accordance with the following $$R_{42} = \sqrt{\frac{L_{41}}{C_{41}}} \tag{E24}$$

The proper ratio between the capacitance values of capacitor C41 and capacitor C42 can be obtained by means of equation E8, in which equation E8 may be rewritten in order to meet the low pass filter 40*a* setting according to the following equation $$\frac{\sqrt{2}}{R_{42}C_{42}} = \frac{1}{\sqrt{L_{41}(C_{41} + C_{42})}} \tag{E25}$$

If the proper ratio between the capacitance values of capacitor C41 and capacitor C42 is expressed in a ratio factor n, than the capacitance value of capacitor C42 may be set equal to the following expression $$C_{42} = nC_{41} \tag{E26}$$

Substituting Expression E24 and E26 into Equation E25 Results in the Following equation $$\frac{\sqrt{2}}{\sqrt{\frac{L_{41}}{C_{41}}}\, nC_{41}} = \frac{1}{\sqrt{L_{41}(C_{41} + nC_{41}}} \tag{E27}$$

If equation E27 is solved for n, in which n is the optimal ratio factor in conjunction with the optimal damping resistance resided in expression E24 as described above, than n is equal to the following result $$n = 1 + \sqrt{3} \tag{E28}$$

and subsequently expression E26 can be written as $$C_{42} = (1 + \sqrt{3})C_{41} \tag{E29}$$

In Order to Obtain the Desired Impulse Response of the Filter 40*a* Setting, the quality factor Q may be adjusted by means of resistor R41 yielding a lower quality factor Q with increasing resistance of resistor R41. The relationship between the resistance of resistor R41 and the quality factor Q can be expressed in accordance with the following $$R_{41} = \left(\frac{1}{Q} - \sqrt{2}\right)\sqrt{\frac{L_{41}}{C_{41} + C_{42}}} \quad \left\{Q \le \frac{1}{\sqrt{2}}\right\} \tag{E30}$$

The single ended filter 40*a* setting and the equivalent differential filter 40*b* setting provide an approach that allows a stable extraction filter obtaining a wide operational bandwidth with a flat frequency response and roll-off characteristics comparable to the single ended filter 30*a* and differential filter 30*b* embodiments. It is to be noted that in filter 40*a* and filter 40*b* less power will be dissipated by the resistors of the extraction filter as the high frequencies in the signal supplied to the resistor are attenuated obtaining high efficiency with respect to the above described filter embodiments shown in FIGS. 4-9. In filter 40*a* and filter 40*b* less power will be dissipated by the resistors of the extraction filter as the high frequencies in the signal supplied to the resistor are attenuated.

FIG. 12 illustrates the circuit diagram of single ended extraction filter 50*a*, which exhibits a passive low pass fourth order filter, constituted of a first RLC filter stage 106 and a second RLC filter stage 108, wherein the component value setting of extraction filter 50*a* and subsequently the derived differential filter 50*b* setting as described hereinafter will be implemented from the point of view of damping the signal component at the resonant frequency emanated from the under damped first filter stage by means of the constituted damping components resided in the second filter stage.

As shown in FIG. 12, the low pass filter 50*a* configuration may receive a high voltage pulse modulated signal provided at input terminal IN51 with respect to ground, wherein a first second stage 108 of filter 50*a* comprises a series connection of a second stage resistor R51, a second stage inductor L51 and a second stage capacitor C51, the series connection connected between input terminal IN51 and a ground node, and wherein a first filter stage of filter 50*a* comprises a series connection of a first stage resistor R52, a first stage inductor L52 and a first stage capacitor C52, the series connection connected between a first stage input terminal and a ground node, a node between the second stage inductor L51 and the second stage capacitor C51 is coupled to the output node of the second filter stage 108, the output node is coupled to the first stage input terminal of the first filter stage 106. The constituted first stage capacitor C52 in the low pass filter 50*a* configuration represents the capacitive load of an electrostatic speaker element.

Ideally the roll-off of the low pass fourth order filter 50*a* setting provides an attenuation of 80 dB per decade after the second cut-off frequency. The output function of filter 50*a* is defined in accordance with the following $$Z_{filter\text{-}50a}(s)=(R_{51}+R_{52}+sL_{51}+sL_{52}+sR_{51}R_{52}C_{51}+s^2R_{52}L_{51}C_{51}+s^2R_{51}L_{52}C_{51}+s^3L_{51}L_{52}C_{51}(1+R_{51}C_{51}+sR_{51}C_{52}+sR_{52}C_{52}+s^2R_{51}R_{52}C_{51}C_{52}+s^2L_{51}C_{51}+s^2L_{51}C_{52}+s^2L_{52}C_{52}+s^3R_{52}L_{51}C_{51}C_{52}+s^3R_{51}L_{52}C_{51}C_{52}+s^4L_{51}L_{52}C_{51}C_{52} \quad \text{(E31)}$$

and the transfer function of filter 50*a* is defined as $$H_{filter\text{-}50a}(s)=1/(1+R_{51}C_{51}+sR_{51}C_{52}+sR_{52}C_{52}+s^2R_{51}R_{52}C_{51}C_{52}+s^2L_{51}C_{51}+s^2L_{51}C_{52}+s^2L_{52}C_{52}+s^3R_{52}L_{51}C_{51}C_{52}+s^3R_{51}L_{52}C_{51}C_{52}+s^4L_{51}L_{52}C_{51}C_{52}) \quad \text{(E32)}$$

FIG. 13 illustrates the circuit diagram of differential extraction filter 50*b*, which exhibits a passive low pass fourth order filter.

as Shown in FIG. 13, the Low Pass Filter 50B Configuration May Receive a High voltage pulse modulated signal provided at first input terminal IN52*a* with respect to a complemented high voltage pulse modulated signal provided at second input terminal IN52*b*, wherein a second filter stage 108 of filter 50*b* comprises a series connection of a first second stage resistor R53*a*, a first second stage inductor L53*a*, a second stage capacitor C53, a second second stage inductor L53*b* and a second second stage resistor R53*b*, the series connection connected between a first input terminal IN52*a* and a second input terminal IN52*b*, a first filter stage 106 of filter 50*b* comprises a series connection of a first first stage resistor R54*a*, a first first stage inductor L54*a*, a first stage capacitor C54, a second first stage inductor L54*b* and a second first stage resistor R54*b*, the series connection connected between a first first stage input terminal and a second first stage input terminal, a node between the first second stage inductor L53*a* and the second stage capacitor C53 is coupled to a first output node of the second filter stage 108 and a node between the second second stage inductor L53*b* and the second stage capacitor C53 is coupled to a second output node of the second filter stage 108, the first output node is coupled to the first first stage input terminal and the second output node is coupled to the second first stage input terminal. The constituted first stage capacitor C54 in the low pass filter 50*b* configuration may represent the capacitive load of an electrostatic speaker element.

The differential filter 50*b* setting exhibits the equivalent model of the single ended filter 50*a* setting, which is implemented in another form. In order to match the filter characteristics of both the single ended filter 50*a* setting and the differential filter 50*b* setting, the resistance of resistor R51 is divided by 2 and assigned to the resistors R53*a* and R53*b*, the resistance of resistor R52 is divided by 2 and assigned to the resistors R54*a* and R54*b*, furthermore the inductance of inductor L51 is divided by 2 and assigned to the inductors L53*a* and L53*b*, the inductance of inductor L52 is divided by 2 and assigned to the inductors L54*a* and L54*b*, the capacitance of capacitor C53 is equal to the capacitance of capacitor C51 and finally the capacitance of capacitor C52 is equal to the capacitance of capacitor C54 representing the specified capacitive load.

In case a single ended filter 50*a* setting is employed, it is emphasised to obtain a first ratio between the capacitance values of capacitor C51 and capacitor C52 and a second ratio between the inductance values of inductor L51 and inductor L52, in which the first and second proper ratios in conjunction with the proper damping resistance of the resistors R51 and R52 will meet the optimum attenuation characteristics. In order to obtain the optimum low pass filter 50*a* setting with an operational bandwidth as wide and a frequency response as flat as possible, it is desired to eliminate resistor R52 in the extraction filter 50*a* configuration. However, due to the practical limitations of inductor L52 a small resistance value will remain, in which resistor R52 may represent the internal DC resistance of inductor L52. As a result the low pass filter 50*a* configuration becomes a good approximation to the optimum low pass filter 50*a* setting. Therefore, without compromising the results, resistor R52 constituted in the low pass filter 50*a* configuration will be ignored in the following equations and descriptions disclosed until further notice.

In order to meet the optimum damping requirement the resistance value of resistor R51 is set equal to the characteristic impedance of the first stage RLC circuit comprising inductor L51 and capacitor C51 in conjunction with quality factor Q51 in order to set the damping of the first stage RLC circuit, and the characteristic impedance of the second stage RLC circuit comprising inductor L52 in conjunction with the capacitors C51 and C52 as can be expressed in accordance with the following $$R_{51} = \sqrt{\frac{L_{51}}{Q_{51}^2(C_{51}+C_{52})} + \frac{L_{52}}{C_{52} - \frac{C_{51}C_s}{C_{51}+C_{52}}}} \quad \text{(E33)}$$

$$\{0 < Q_{51}\}$$

wherein the capacitance value Cs represents the equivalent value of capacitor C51 series connected to capacitor C52 as can be expressed as $$C_s = \frac{C_{51}C_{52}}{C_{51}+C_{52}} \quad \text{(E34)}$$

The proper ratios between the constituted capacitor and inductor values can be obtained by means of equation E8, in which equation E8 may be rewritten in order to meet the single ended filter 50*a* setting according to the following equation $$\frac{\sqrt{2}}{R_{51}(C_{51}+C_{52})} = \frac{1}{\sqrt{L_{51}(C_{51}+C_{52})+L_{52}C_{52}}} \quad \text{(E35)}$$

If the proper ratios between the constituted capacitor and inductor values are expressed in the ratio factors n and m, than the capacitance value of capacitor C52 and the inductance value of inductor L52 may be set equal to the following expressions $$C_{52}=nC_{51} \tag{E36}$$

and $$L=nmL_{51} \tag{E37}$$

Substituting Expression E33, E36 and E37 into Equation E35 Results in the following equation $$\frac{\sqrt{2}}{\sqrt{\frac{L_{51}}{Q_{51}^2(C_{51}+nC_{51})}+\frac{nmL_{51}}{nC_{51}-\frac{C_{51}\frac{C_{51}nC_{51}}{C_{51}+nC_{51}}}{C_{51}+nC_{51}}}(C_{51}+nC_{51})}}=\frac{1}{\sqrt{L_{51}(C_{51}+nC_{51})+nmL_{51}nC_{51}}}\ \{0<Q_{51},\ 0<m\} \tag{E38}$$

If equation E38 is solved for n, wherein the ratio factor m is set to 1.0 in conjunction with the optimal damping resistance wherein the quality factor Q51 is set to $1/\sqrt{2}$ resulting in an operational bandwidth as wide and a frequency response as flat as possible, than n is equal to the following rounded result $$n=2.7540 \tag{E39}$$

subsequently expressions E36 and E37 can be written as $$C_{52}=2.7540 \tag{E40}$$

and $$L_{52}=2.7540L_{51} \tag{E41}$$

Depending on the Specifications of the Single Ended Filter 50*a* Setting, a Different ratio factor in as well as a different quality factor Q51 may be set resulting in a new proper ratio factor n by resolving equation E38 once more. Therefore, the single ended filter 50*a* setting would appear a proper working filter as long as the ratio factors m and n between the constituted capacitor and inductor values in conjunction with a proper damping resistance are set as described above provided that quality factor Q51 is equal or smaller than $1/\sqrt{2}$.

In order to obtain the desired impulse response of the filter 50*a* setting, the overall quality factor Q of the filter 50*a* setting may be adjusted by means of adjusting the quality factors Q51 and Q52, provided that quality factor Q51 equals quality factor Q52, in which the resistance value of resistor R52 will set quality factor Q52 as can be expressed in accordance with the following $$R_{52}=\left(\frac{1}{Q_{52}}-\sqrt{2}\right)\sqrt{\frac{L_{52}}{C_{52}}}\qquad \left\{Q_{52}=Q_{51},\ Q_{52}\le\frac{1}{\sqrt{2}}\right\} \tag{E42}$$

The single ended filter 50*a* setting and the equivalent differential filter 50*b* setting provide an approach that allows a stable extraction filter obtaining a further increase of attenuation of the switching frequency and its harmonics by means of the additional constituted inductors L52, L54*a* and L54*b* in both the single ended filter 50*a* and differential filter 50*b* configurations with respect to the single ended filter 40*a* and differential filter 40*b* embodiments.

FIG. 14 illustrates the circuit diagram of single ended extraction filter 60*a*, which exhibits the preferred passive low pass fourth order filter embodiment constituted of a first RLC filter stage 106 and a second RLC filter stage 108 similarly to the single ended filter 50*a* configuration as shown in FIG. 12, however with interchanged definition of first and second filter stage. Similar to the component value setting of single ended filter 50*a*, the component value setting of single ended filter 60*a* and subsequently the derived differential filter 60*b* setting as described hereinafter, will be implemented from the point of view of damping the signal component at the resonant frequency emanated from the under damped first filter stage by means of the constituted damping components resided in the second filter stage.

As shown in FIG. 14, the low pass filter 60*a* configuration may receive a high voltage pulse modulated signal provided at input terminal IN61 with respect to ground, wherein the first filter stage 106 of filter 60*a* comprises a series connection of a first stage resistor R61, a first stage inductor L61 and a first stage capacitor C61, the series connection connected between the input terminal IN61 and a ground node, and wherein the second filter stage 108 of filter 60*a* comprises a series connection of a second stage resistor R62, a second stage inductor L62 and a second stage capacitor C62, the series connection connected between a second filter stage input and a ground node, a node between the first stage inductor L61 and the first stage capacitor C61 is coupled to the output node of the first filter stage 106, the output node is coupled to the input of the second filter stage 108. The constituted second stage capacitor C62 in the low pass filter 60*a* configuration represents the capacitive load of an electrostatic speaker element.

Ideally the roll-off of the low pass fourth order filter 60*a* setting provides an attenuation of 80 dB per decade after the second cut-off frequency. The output function of filter 60*a* is defined in accordance with the following $$\begin{aligned}Z_{filter60a}(s)=&(R_{61}+R_{62}+sL_{61}+sL_{62}+sR_{61}R_{62}C_{61}+\\&s^2R_{62}L_{61}C_{61}s^2R_{61}L_{62}C_{61}+s^3L_{61}L_{62}C_{61}(1+\\&sR_{61}C_{61}+sR_{61}C_{62}+sR_{62}C_{62}+s^2R_{61}R_{62}C_{61}C_{62}+\\&s^2L_{61}C_{61}+s^2L_{61}C_{62}+s^2L_{62}C_{62}+s^3R_{62}L_{61}C_{61}C_{62}+\\&s^3R_{61}L_{62}C_{61}C_{62}+s^4L_{61}L_{62}C_{61}C_{62}\end{aligned} \tag{E43}$$

and the transfer function of filter 60*a* is defined as $$\begin{aligned}H_{filter60a}(s)=&1/(1+sR_{61}C_{61}+sR_{61}C_{62}+sR_{62}C_{62}+\\&s^2R_{61}R_{62}C_{61}C_{62}+s^2L_{61}C_{61}+s^3L_{61}C_{62}+s^2L_{62}C_{62}+\\&s^3R_{62}L_{61}C_{61}C_{62}+s^3R_{61}L_{62}C_{61}C_{62}+\\&s^4L_{61}L_{62}C_{61}C_{62})\end{aligned} \tag{E44}$$

FIG. 15 illustrates the circuit diagram of differential extraction filter 60*b*, which exhibits a passive low pass fourth order filter.

as Shown in FIG. 15, the Low Pass Filter 60B Configuration May Receive a High voltage pulse modulated signal provided at a first input terminal IN62*a* with respect to a complemented high voltage pulse modulated signal provided at a second input terminal IN62*b*, wherein the first filter stage 106 of filter 60*b* comprises a series connection of a first first stage resistor R63*a*, a first first stage inductor L63*a*, a first stage capacitor C63, a second first stage inductor L63*b* and a second first stage resistor R63*b*, the series connection connected between the first input terminal IN62*a* and the second input terminal IN62*b*, the second filter stage of filter 60*b* comprises a series connection of a first second stage resistor R64*a*, a first second stage inductor L64*a*, a second stage capacitor C64, a second second stage inductor L64*b* and a second second stage resistor R64*b*, the series connection connected between a first second stage terminal and a second second stage terminal, a node between the first first stage inductor L63*a* and the first stage capacitor C63 is coupled to a first output node of the first filter stage 106 and a node between the second first stage inductor L63*b* and the first stage capacitor C63 is coupled to a second output node of the first filter stage 106, the first output node is coupled to the first second stage terminal and the second output node is coupled to the second second stage terminal. The constituted second stage capacitor C64 in the low pass filter 60*b* configuration represents the capacitive load of an electrostatic speaker element.

The differential filter 60*b* setting exhibits the equivalent model of the single ended filter 60*a* setting, which is implemented in another form. In order to match the filter characteristics of both the single ended filter 60*a* setting and the differential filter 60*b* setting, the resistance of resistor R61 is divided by 2 and assigned to the resistors R63*a* and R63*b*, the resistance of resistor R62 is divided by 2 and assigned to the resistors R64*a* and R64*b*, furthermore the inductance of inductor L61 is divided by 2 and assigned to the inductors L63*a* and L63*b*, the inductance of inductor L62 is divided by 2 and assigned to the inductors L64*a* and L64*b*, the capacitance of capacitor C61 is equal to the capacitance of capacitor C63 and finally the capacitance of capacitor C62 is equal to the capacitance of capacitor C64 representing the specified capacitive load.

In the case a single ended filter 60*a* setting is employed, it is emphasised to obtain a first ratio between the capacitance values of capacitor C61 and capacitor C62 and a second ratio between the inductance values of inductor L61 and inductor L62, in which the first and second proper ratios in conjunction with the proper damping resistance of the resistors R61 and R62 will meet the optimum attenuation characteristics. In order to obtain the optimum low pass filter 60*a* setting with an operational bandwidth as wide and a frequency response as flat as possible, it is desired to eliminate resistor R61 in the extraction filter 60*a* configuration. However, due to the practical limitations of inductor L61 a small resistance value will remain, in which resistor R61 may represent the internal DC resistance of inductor L61. As a result the low pass filter 60*a* configuration becomes a good approximation to the optimum low pass filter 60*a* setting. Therefore, without compromising the results, resistor R61 constituted in the low pass filter 60*a* configuration will be ignored in the following equations and descriptions disclosed until further notice.

In order to meet the optimum damping requirement the resistance value of resistor R62 is set equal to the characteristic impedance of the first stage RLC circuit comprising inductor L61 and capacitor C61 and the characteristic impedance of the second stage RLC circuit comprising inductor L62 and the capacitors C61 and C62 in conjunction with the quality factor Q62 in order to set the damping of the second stage RLC circuit as can be expressed in accordance with the following $$R_{62} = \sqrt{\frac{L_{61}}{C_{61}} + \frac{\left(4 - \frac{1}{Q_{62}^2}\right)L_{62}}{C_s}} \tag{E45}$$

-continued $$\left\{\frac{1}{2} < Q_{62}\right\}$$

wherein the capacitance value Cs represents the equivalent value of capacitor C61 series connected to capacitor C62 as can be expressed as $$C_s = \frac{C_{61}C_{62}}{C_{61} + C_{62}} \tag{E46}$$

The proper ratios between the constituted capacitor and inductor values can be obtained by means of equation E8, in which equation E8 may be rewritten in order to meet the single ended filter 60*a* setting according to the following equation $$\frac{\sqrt{2}}{R_{62}C_{62}} = \frac{1}{\sqrt{L_{61}(C_{61} + C_{62}) + L_{62}C_{62}}} \tag{E47}$$

If the proper ratios between the constituted capacitor and inductor values are expressed in the ratio factors m and n, than the capacitance value of capacitor C62 and the inductance value of inductor L61 may be set equal to the following expressions $$C_{62}=nC_{61} \tag{E45}$$

and $$=L_{61}=nmL_{62} \tag{E49}$$

Combining the Expressions E48 and E49 with Ratio Factor in Set to One, the following equation may be written as $$L_{61}C_{61}=L_{62}C_{62} \tag{E50}$$

Substituting expression E45, E48 and E49 into equation E47 results in the following equation $$\frac{\sqrt{2}}{\sqrt{\frac{nmL_{62}}{C_{61}} + \frac{\left(4 - \frac{1}{Q_{62}^2}\right)L_{62}}{\frac{C_{61}nC_{61}}{C_{61} + nC_{61}}}\,nC_{61}}} = \frac{1}{\sqrt{nmL_{62}\left(\frac{C_{61} +}{nC_{61}}\right) + L_{62}nC_{61}}} \tag{E51}$$

$$\text{wherein } \left\{\frac{1}{2} < Q_{62},\ 0 < m\right\}$$

If equation E51 is solved for n, wherein the ratio factor m is set to 1.0 in conjunction with the optimal damping resistance wherein the quality factor Q62 is set to 1/√2 resulting in an operational bandwidth as wide and a frequency response as flat as possible, than n is equal to the following result $$n=\sqrt{2} \tag{E52}$$

subsequently expressions E48 and E49 can be written as $$C_{62}=\sqrt{2}C_{61} \tag{E53}$$

and $$L_{61}=\sqrt{2}L_{62} \tag{E54}$$

Depending on the Specifications of the Single Ended Filter 60*a* Setting, a Different ratio factor m as well as a different quality factor Q62 may be set resulting in a new proper ratio factor n by resolving equation E51 once more. Therefore, the single ended filter 60*a* setting would appear a proper working filter as long as the ratio factors m and n between the constituted capacitor and inductor values in conjunction with a proper damping resistance are set as described above provided that quality factor Q62 is equal or smaller than $1/\sqrt{2}$.

In order to obtain the desired impulse response of the filter 60*a* setting, the overall quality factor Q of the filter 60*a* setting may be adjusted by means of adjusting the quality factors Q61 and Q62, provided that quality factor Q61 equals quality factor Q62, in which the resistance value of resistor R61 will set quality factor Q61 as can be expressed in accordance with the following $$R_{61} = \left(\frac{1}{Q_{61}} - \sqrt{2}\right)\sqrt{\frac{L_{61}}{C_{61} + C_{62}} + \frac{L_{62}}{C_{62}}} \quad \text{(E55)}$$

$$\left\{Q_{61} = Q_{62},\ Q_{61} \le \frac{1}{\sqrt{2}}\right\}$$

The single ended filter 60*a* embodiment and equivalent differential filter 60*b* embodiment as described above exhibit the preferred extraction filter embodiments of the present invention providing an approach that may conduce to a well designed and stable extraction filter showing very good results in the frequency domain as well as in the signal domain and will obtain in addition low residual switching energy from being dissipated in the constituted damping resistors achieving an efficient extraction filter, subsequently the preferred extraction filter may form the desired starting point of additional filter means as described hereinafter.

In general it is to be noted, that the proper damping requirements for the third and higher order extraction filter embodiments as described in the present invention comprising at least a first low pass filter stage and a second low pass filter stage, will be obtained from the point of view of damping the signal component at the resonant frequency emanated from the first filter stage comprising an under damped RLC circuit having a characteristic resonance frequency ω0 and a quality factor Q>½ by means of a second filter stage comprising at least one component for damping the signal component at the resonant frequency of the under damped RLC circuit, wherein an output of the first filter stage may be coupled to the input of the second filter stage resulting in a second stage capacitor being the capacitive load at the output of the extraction filter as well as an extraction filter configuration wherein the output of the second filter stage is coupled to the input of the first filter stage and the capacitive load at the output of the extraction filter will be the first stage capacitor. However in an alternative third and higher order extraction filter embodiment implemented within the scope of the present invention comprising at least a first low pass filter stage and a second low pass filter stage, it will be possible to damp a signal component at the resonant frequency of an uncoupled filter stage by itself comprising an under damped RLC circuit having a resonant frequency ω0 and a quality factor Q>½ implemented with at least one component for damping the signal component at the resonant frequency of the under damped RLC circuit, still yielding a stable extraction filter with moderate extraction filter properties provided that the uncoupled filter stage is reconnected.

FIG. 16 illustrates the circuit diagram of single ended extraction filter 70*a*, which exhibits a low pass filter encompassing the low pass filter 60*a* configuration as shown in FIG. 14, wherein the second filter stage 108 includes a further second stage capacitor C73 parallel connected to the second stage inductor L72 implementing a second order parallel resonant filter also called a notch filter in this configuration.

As shown in FIG. 16, the low pass filter 70*a* configuration may receive a high voltage pulse modulated signal provided at input terminal IN71 with respect to ground, wherein the first filter stage 106 comprises a series connection of a first stage resistor R71, a first stage inductor L71 and a first stage capacitor C71, the series connection connected between the input terminal IN71 and a ground node, and wherein the second filter stage 108 comprises a series connection of a second stage resistor R72, a second stage inductor L72 and a second stage capacitor C72, the series connection connected between a second stage input terminal and a ground node, wherein the second filter stage 108 further comprises a parallel connection of the further second stage capacitor C73 and the second stage inductor L72, a node between the first stage inductor L71 and the first stage capacitor C71 is coupled to the output node of the first filter stage 106, the output node is coupled to the second stage input terminal of the second filter stage 108. The constituted second stage capacitor C72 in the low pass filter 70*a* configuration represents the capacitive load of an electrostatic speaker element.

Ideally the roll-off of the low pass fifth order filter 70*a* setting provides an attenuation of 60 dB per decade on either side of the notch frequency after the second cut-off frequency.

A low pass filter configuration extended with a parallel resonant filter as shown in the single ended extraction filter 70*a* configuration may be implemented employing a pulse modulated signal with a fixed switching frequency, in which the resonance frequency of the parallel resonance circuit constituted of inductor L72 and capacitor C73 may be matched with the fundamental of a high voltage pulse modulated signal presented at the input IN71 of the extraction filter 70*a* setting. As a result the parallel resonant filter implemented in the extraction filter 70*a* configuration will block the fundamental of the pulse modulated signal to some degree attenuating the residual switching voltage across the capacitive load C72 of an electrostatic speaker element. Furthermore the blocked fundamental of the residual switching voltage across the parallel resonant filter will decrease the residual switching energy in the series connected damping resistance R72 from being dissipated obtaining a higher efficiency level. The attenuation in the notch of the narrowband parallel resonance filter will arise from the series connected impedance value with in this setting resistance R72 in particular in conjunction with the quality characteristics of the constituted inductor L72 as well as the capacitor C73 each defined by the quality factor Q as described later in more detail. Subsequently in order to enhance the attenuation in the notch of the parallel resonance filter in practice, it is required to implement a capacitor C73 and an inductor L72 in particular showing a high quality factor Q, in which the internal DC resistance of inductor L72 is as small as physically possible. In order to match the notch frequency of the parallel resonant filter with the fundamental of a pulse modulated signal in practice, the capacitance value of capacitor C73 can be made variable in whole or in part by means of a trimmer capacitor not shown.

The extraction filter 70*a* setting can be implemented taken advantage of the working method and the equations E45, E51 and E55 in the manner described in the low pass filter 60*a* embodiment. For example the components specified for the extraction filter 70*a* setting may be implemented in accordance with the quality factors Q51 and Q52 both set to $2/\pi$ and the ratio factor m set to 1.0 in conjunction with an operational bandwidth of approximately 65 kHz and a capacitive load of 400 pF represented by capacitor C72 resulting in the following calculated and rounded values: ratio factor n is 1.8218, resistor R71 is set to 938 Ohm and resistor R72 is set to 11.2 kOhm, inductor L71 is set to 12.0 mH and inductor L72 is set to 6.6 mH, capacitor C71 is set to 220 pF. In the case a pulse modulated signal with a fixed switching frequency of 400 kHz will be employed, of which the resonance frequency of the parallel resonance circuit constituted of inductor L72 and capacitor C73 may be matched with the fundamental of the presented switching frequency, capacitor C73 can be calculated with the following equation without compromising the results of the extraction filter 70*a* setting provided that the switching frequency is at least an order of magnitude higher with respect to the operational bandwidth of the extraction filter 70*a* setting and can be expressed as $$C_{73} = \frac{1}{4\pi^2 f_{sw}^2 L_{72}} \tag{E56}$$

According to a switching frequency of 400 kHz and an inductance value of 6.6 mH represented of inductor L72 taking advantage of equation E56 results in a rounded capacitance value of 24 pF for capacitor C73.

The extraction filter 70*a* setting implemented in accordance with the calculated component values as presented above will conduce to a very good impulse response requirement in conjunction with the fixed frequency pulse modulated switching signal provided at input terminal IN71 and the capacitive load of an electrostatic speaker element coupled to the output of the extraction filter. In addition the phase response of the extraction filter 70*a* setting will be a near perfect linear function of frequency within the operational bandwidth resulting in an advantageous constant group delay.

FIG. 17 illustrates the circuit diagram of differential extraction filter 70*b*, which exhibits a low pass filter encompassing the low pass filter 60*b* configuration as shown in FIG. 15, wherein the second filter stage includes a first further second stage capacitor C76*a* parallel connected to the second stage inductor L74*a* and a second further second stage capacitor C76*b* parallel connected to the second stage inductor L74*b* implementing two second order parallel resonant filters as described above.

As shown in FIG. 17, the low pass filter 70*b* configuration may receive a high voltage pulse modulated signal provided at input terminal IN72*a* with respect to a complemented high voltage pulse modulated signal provided at input terminal IN72*b*, wherein the first filter stage 106 comprises a series connection of a first first stage resistor R73*a*, a first first stage inductor L73*a*, a first stage capacitor C74, a second first stage inductor L73*b* and a second first stage resistor R73*b*, the series connection connected between the first input terminal IN72*a* and the second input terminal IN72*b*, the second filter 70*b* stage comprises a series connection of a first second stage resistor R74*a*, a first second stage inductor L74*a*, a second stage capacitor C75, a second second stage inductor L74*b* and a second second stage resistor R74*b*, the series connection connected between a first second stage input terminal and a second second stage input terminal, wherein the second filter 70*b* stage further comprises the first further second stage capacitor C76*a* parallel connected to the first second stage inductor L74*a* and the second further second stage capacitor C76*b* parallel connected to the second second stage inductor L74*b*, a node between the first first stage inductor L73*a* and the first stage capacitor C74 is coupled to a first output node of the first filter stage 106 and a node between the second first stage inductor L73*b* and the first stage capacitor C74 is coupled to a second output node of the first filter stage 106, the first output node is coupled to the first second stage input terminal and the second output node is coupled to the second second stage input terminal. The constituted second stage capacitor C75 in the low pass filter 70*b* configuration represents the capacitive load of an electrostatic speaker element.

The differential filter 70*b* setting exhibits the equivalent model of the single ended filter 70*a* setting, which is implemented in another form. The extraction filter 70*b* setting can be implemented taken advantage of the working method and the equations E45, E51 and E55 in the manner described in the low pass filter 60*a* and low pass filter 60*b* embodiments. For example the components specified for the extraction filter 70*b* setting may be implemented in accordance with the quality factors Q51 and Q52 both set to $2/\pi$ and the ratio factor in set to 1.0 in conjunction with an operational bandwidth of approximately 65 kHz and a capacitive load of 100 pF represented of capacitor C75 resulting in the following calculated and rounded values: ratio factor n is 1.8218, the resistors R73*a* and R73*b* are set to 1.9 kOhm, the resistors R74*a* and R74*b* are set to 22.4 kOhm, the inductors L73*a* and L73*b* are set to 24 mH, the inductors L74*a* and L74*b* are set to 13.2 mH and capacitor C74 is set to 55 pF. In the case a pulse modulated signal with a fixed switching frequency of 400 kHz will be employed, in which the resonance frequency of the parallel resonance circuits implemented in the extraction filter 70*b* configuration may be matched with the fundamental of the presented switching frequency taken advantage of equation E56 as described above, than the rounded capacitance value calculated for the capacitors C76*a* and C76*b* is 12 pF in a well balanced filter 70*b* setting.

The component values presented for the extraction filter 70*a* and filter 70*b* settings are provided for example purposes only, and are not intended to be exhaustive or to be limited as will be understood by those skilled in the arts based on the discussion given herein. Different values of the ratio factors m and n, switching frequency, capacitive load, and required bandwidth and impulse response will result in different component values for the components of the extraction filter. Furthermore the resonance filter technique used in the preferred embodiment of the invention is not limited to the exemplary parallel resonance filter constituted in the extraction filter 70*a* and filter 70*b* configurations as described above and includes other notch filter means, such as a combination of one or several parallel as well as series resonant filters, which are optimized for notching one or several frequency components of a high voltage pulse modulated signal in conjunction with single ended as well as differential extraction filter configurations.

It is to be noted, that the implemented filter order enclosed in an extraction filter configuration is not limited to the number shown in an extraction filter embodiment as is covered by the present invention but rather determined in accordance with the suppression characteristics of the switching frequency in conjunction with for example the operational bandwidth and the total capacitive load.

FIG. 18 illustrates the circuit diagram of single ended extraction filter 80*a*, which exhibits a low pass filter encompassing single ended extraction filter 60*a* as shown in FIG. 14, comprising M further second filter 80*a* stages each yielding a low pass first order filter as shown in FIG. 4 and connected in parallel to the main second filter stage 108, in which M is an integer greater or equal to one. The further second filter stages parallel to the second filter stage 108 provide an approach that allows segmenting an electrostatic speaker element in M plus one electrically filtered segments.

As shown in FIG. 18, the low pass filter 80*a* configuration may receive a high voltage pulse modulated signal provided at input terminal IN81 with respect to ground, wherein a first filter stage 106 comprises a series connection of a first stage resistor R81, a first stage inductor L81 and a first stage capacitor C81, the series connection connected between a input terminal IN81 of the low pass filter configuration and a ground node, wherein a main second filter 80*a* stage comprises a series connection of a second stage resistor R82, a second stage inductor L82 and a second stage capacitor C82, the series connection connected between a second filter stage input terminal and a ground node. The low pass filter configuration further comprising M further second filter stages each comprising a series connection of a further second stage resistor R83(A,B,C,etc.) and a further second stage capacitor C83(A,B,C,etc), wherein the series connection is connected between a further second filter stage input terminal and the ground node, a node between the first stage inductor L81 and the first stage capacitor C81 is coupled to the output node of the first filter 80*a* stage, the output node is coupled to the main second stage input terminal and the M further second stage input terminals. The second stage capacitor C82 and the M further second stage capacitors C83(A,B,C,etc.) implemented in the extraction filter 80*a* configuration represents the capacitive loads residing in an electrostatic speaker or element.

Ideally the main low pass fourth order filter 80*a* roll-off provides an attenuation of 80 dB per decade after the second cut-off frequency and each further supplemented low pass third order filter roll-off will provide an attenuation of 60 dB per decade after the second cut-off frequency.

The extraction filter 80*a* setting can be implemented taken advantage of the working method and the equations E1, E45, E51 and E55 in the manner described in the single ended extraction filter 10*a* and the single ended extraction filter 60*a* embodiments.

The second stage capacitor C82 and the M further second stage capacitors C83(A,B,C,etc.) exhibit the characteristic capacitance values of the M plus one segments implemented in an electrostatic speaker element, in which the first segment represented by capacitor C82 will obtain a signal having the total operational bandwidth and the remaining segments represented by the M further second stage capacitors C83(A,B,C,etc.) will obtain a signal having a specified part of the operational bandwidth providing for example sub low, low and mid low audio frequency capability. The characteristic capacitance of the segment projecting the total operational bandwidth represented of capacitor C82 may form the starting point in filter calculation equal to the single ended extraction filter 60*a* setting as described above, ignoring the M further second stage resistors R83(A,B,C,etc.) and the M further second stage capacitors C83(A,B,C,etc.). Subsequently the remaining characteristic capacities of the segments represented of the M further second stage capacitors C83(A,B,C,etc) form the capacitive components employed in the M further second stage first order filters constituted in conjunction with the additional M further second stage resistors R83(A,B,C,etc.), in which the cut-off frequency of each low pass first order filter may be tuned to a desired part of the operational bandwidth taken advantage of equation E1 and implemented as the circuit diagram of FIG. 18 prescribes.

The approach of segmenting an electrostatic speaker element electrically providing a technique that allows a skilled person adapting the electrostatic speaker element acoustically used in the preferred embodiment of the invention, is not limited to the exemplary filtering means in conjunction with the segmentation means as described above and includes for example analogue signal delay means, in which typical a lower part of the initial operational bandwidth can be delayed gradual with a specified amount of time by means of a passive delay circuit driving each additional segment with a desired signal delay time in order to obtain a tapped delay line of segments. Hence a segmented electrostatic speaker element projecting a signal pattern that is similar for example to a pulsating sphere.

If taken a retrospective view of FIG. 18 illustrating the circuit diagram of single ended extraction filter 80*a*, a further second stage inductor (not shown) may be connected between the further second stage resistor R83(A,B,C,etc.) and the respective further second stage capacitor C83(A,B,C,etc.) forming a second stage passive delay circuit. Subsequently the first segment represented of second stage capacitor C82 comprises the initial operational bandwidth with minimum signal delay time and the remaining segments, represented by the M further second stage capacitors C83(A,B,C,etc.), comprise a delayed part of the operational bandwidth each specified in the signal and frequency domain forming a tapped delay line. Needless to say, that a tapped delay line may be constituted with a plurality of cascade connected passive delay circuits each comprising the capacitance representing a segment. Furthermore a tapped delay line comprising an extraction filter embodiment according to the present invention, which is optimized for a specified signal delay time, may be implemented in conjunction with a parallel connected initial extraction filter as well, enclosing for example a plurality of other delay as well as extraction filter embodiments driving one or several segments as described above.

FIG. 19 illustrates the circuit diagram of a differential extraction filter 80*b*, which exhibits a low pass filter encompassing differential extraction filter 60*b* as shown in FIG. 15. The circuit diagram further comprising M further second filter stages each yielding a low pass first order filter as shown in FIG. 5. In FIG. 19 M=3. The M further second filter stages are connected in parallel to the main second filter stage 108. The M further second filter stages provide an approach that allows a person skilled in the art to segment an electrostatic speaker element in M plus one electrically filtered segments of an electrostatic loudspeaker as described above.

As shown in FIG. 19, the low pass filter 80*b* configuration may receive a high voltage pulse modulated signal provided at a first input terminal IN82*a* with respect to a complemented high voltage pulse modulated signal provided at a second input terminal IN82*b*, wherein the first filter stage 106 comprises a series connection of a first first stage resistor R84*a*, a first first stage inductor L83*a*, a first stage capacitor C84, a second first stage inductor L83*b* and a second first stage resistor R84*b*, the series connection connected between the first input terminal INS2*a* and the second input terminal INS2*b*. A main second filter stage 108 comprises a series connection of a first second stage resistor R85*a*, a first second stage inductor L84*a*, a second stage capacitor C85, a second second stage inductor L84*b* and a second second stage resistor R85*b*, the series connection connected between a first main second stage input terminal and a second main second stage input terminal. The low pass filter 80*b* further comprises M further second filter stages each comprising a series connection of a first further second stage resistor R86*a*(A,B,C, etc.), a further second stage capacitor C86(A,B,C,etc.), and a second further second stage resistor R86*b*(A,B,C,etc.) the series connection connected between a first further second stage input terminal and a second further second stage input terminal. A node between the first first stage inductor L84*a* and the first stage capacitor C84 is coupled to a first output node of the first filter stage 106 and a node between the second first stage inductor L84*b* and the first stage capacitor C84 is coupled to a second output node of the first filter stage 106. The first output node is coupled to the first main second stage input terminal and the first M further second stage input terminals and the second output node is coupled to the second main second stage input terminal and the second M further second stage input terminals. The second stage capacitor C85 and the M further second stage capacitors C86(A,B,C,etc.) implemented in the low pass filter 80*b* configuration represent the capacitive loads resided in an electrostatic speaker element.

The differential filter 80*b* setting exhibits the equivalent model of the single ended filter 80*a* setting, which is implemented in another form. In order to match the filter characteristics of both the single ended filter 80*a* setting and the differential filter 80*b* setting, the extraction filter 80*b* setting can be implemented taken advantage of the working method and the equations E1, E45, E51 and E55 in a manner described in the embodiments of filter 10*a*, filter 10*b*, filter 60*a* and filter 60*b*.

FIG. 20 illustrates the circuit diagram of single ended extraction filter 90, which exhibits a more practical circuit of a band pass filter configuration comprising a first order high pass filter ideally providing a roll-off showing an attenuation of 20 dB per decade before the low cut-off frequency in conjunction with the equivalent low pass filter 40*a* configuration yielding a third order low pass filter ideally providing a roll-off showing an attenuation of 60 dB per decade after the second high cut-off frequency.

As shown, the band pass filter 90 configuration may receive a high voltage pulse modulated signal provided at input terminal IN91 with respect to ground, wherein a first filter stage 106 comprises a series connection of first stage resistors R91(*a,b,c*,etc.), first stage inductors Lreal91(*a,b,c*,etc.), and a first stage capacitor Creal91. The series connection is connected between the input terminal IN91 and a ground node. A second filter stage 108 comprises a series connection of second stage resistors R92(*a,b,c*,etc.), second stage capacitors C92(*a,b,c*,etc.) each parallel connected to resistors R93(*a,b,c*,etc.) and second stage resistors R94(*a,b,c*,etc.) parallel connected to capacitor C93. The series connection connected between a second filter stage input and a ground node, a node between the final first stage inductor Lreal91 and the first stage capacitor Creal91 is coupled to the output node of the first filter stage 106, the output node is coupled to the input of the second filter stage 108. The constituted capacitor C93 in the band pass filter 90 configuration represents the capacitive load of an electrostatic speaker element.

In order to obtain a more improved designed extraction filter in accordance with the present invention, it is emphasised to select the constituted real components with the right characteristic qualifications, affecting the final performance. It is to be noted that in practise printed circuit board layout means, enclosing means as well as connecting means such as a connector, an electrical (shielded) cable or a feed through capacitor may be implemented as an integral real component in the preferred embodiment of an extraction filter in the present invention. Furthermore it is an objective of an extraction filter embodiment to implement real components showing an overall impedance tolerance, which deviates as little as physically possible from the target impedance under the influence of the various conditions such as for example fabrication, temperature, frequency, current, voltage and aging, preserving final filter performance.

In general to meet the applicable voltage requirements of a passive real component, in the case a higher voltage has to be bridged, two or several real components with the same impedance value for example may be connected in series splitting the applied voltage into an applicable voltage value across each real component and subsequently splitting the total loss in the real components as well provided that the real components put in series achieve the same total impedance value as the calculated impedance value for an ideal component.

As illustrated in FIG. 20 the real resistors R91(*a,b,c*,etc.) are series connected splitting the calculated resistance value for a single resistor into lower resistance valued real resistors to achieve the same total resistance value in order to meet the applicable voltage and loss requirements for the constituted real resistors.

The constituted real resistors R91(*a,b,c*,etc.) may serve as a resistive impedance component in order to adjust the overall quality factor Q of the band pass filter 90 setting obtaining the desired impulse response as described above. Furthermore it is desired to implement a real resistor represented of for example the real resistor R91*a* as illustrated in FIG. 20 showing a low parasitic capacitance, good impulse response as well as low noise properties, in which the parasitic inductance will be of less importance affecting filter performance. According to the overall design objectives of an implemented real resistor, a thick film resistor for example with an aluminium-oxide substrate may be selected, representing the real resistors R91(*a,b,c*,etc.).

As illustrated in FIG. 20 the real inductors Lreal91(*a,b,c*, etc.) are series connected splitting the calculated inductance value of a single inductor into lower inductance valued real inductors obtaining the same total inductance value in order to meet the applicable voltage and loss requirements for the constituted real inductors. Additionally, besides splitting the voltage and loss as described above, the current flowing through a real inductor can be met as well by means of connecting real inductors in series, in which a real inductor should be operated well below its maximum current rating and saturation current preserving the effectiveness of the real inductor taking account of a DC current if employed superimposed on the analogue AC signal current and the high frequency ripple current.

The constituted real inductors Lreal91(*a,b,c*,etc.) will serve alongside a filter component for low pass signal filtering as an electrical energy buffer and will furthermore smooth the current flowing through the real inductors. In order to obtain an efficient energy buffer as well as the optimum in extraction filter design, it is required to implement a real inductor for example Lreal91*a* as illustrated in FIG. 20 showing a high quality factor Q, in which the quality factor Q of a real inductor is defined as the ratio of the ideal inductive reactance represented of Lideal91*a* to the sum of all its losses represented of Rloss91*a* and is frequency dependent. Needless to say that the total loss resistance of a real inductor consisting of for example the losses in the core material and the DC resistance of copper wire must be kept to a minimum in order to operate as loss-free as physically possible and acting accordingly preserving the effectiveness and performance of the implemented real inductor.

The construction of the employed real inductors represented of the real inductors Lreal91(*a,b,c*,etc.) may be based on for example a wire wound inductor comprising a high-quality Nickel-Zinc (NiZn) powder core showing very low loss, wherein individual powder particles of the ferrite core are insulated from one another resulting in equally distributed air gaps providing an enhanced energy storage capability and temperature stability in which the leakage magnetic flux will be kept small. Furthermore the employed real inductor may be a magnetically shielded component provided that the inductor remains linear.

Another important issue affecting the performance of a real inductor is the capacitive coupling arising from its windings. The parasitic capacitance for example capacitor Cpar91*a* as illustrated in FIG. 20 will form a parallel resonant circuit with the ideal inductor Lideal91*a*, in which the applicability of the real inductor Lreal91*a* will be limited due to the introduced self-resonant frequency. In practice the implemented real inductors Lreal91(*a,b,c*,etc.) should be operated well below the self-resonant frequency, due to the introduced parasitic parallel resonant circuits acting as a notch filter in the extraction filter 90 configuration in order to avoid distortion. Subsequently it is an objective of the preferred real inductor showing a parasitic capacitance value as low as physically possible in order to shift the introduced self-resonance frequency of the preferred real inductor to an applicable frequency as well as mitigating current spikes during the fast moving transient edges of the high voltage block wave signal provided at the input terminal IN91 of the extraction filter 90 configuration. As illustrated in FIG. 20 the real inductors Lreal91(*a,b,c*,etc.) are series connected splitting the calculated inductance value of a single real inductor into lower inductance valued real inductors obtaining the same total inductance, in which the parasitic capacitance of a single real inductor will be split as well into the lower capacitance valued parasitic capacitors Cpar91(*a,b,c*,etc.) achieving in addition by means of series connection a highly decreased overall parasitic capacitance across the total employed ideal inductance value obtaining enhanced extraction filter performance.

In the case resonance phenomena occur due to additional parasitic elements in conjunction with for example the parasitic capacitance of a real inductor the high frequency resonance effects may be mitigated by means of one or several EMI suppression ferrite beads trimmed for high losses series connected with an implemented real inductor in order to minimize EMI from being conducted or radiated. Needless to say, that the implemented real resistors R91(*a,b,c*,etc.) as illustrated in FIG. 20 may attenuate EMI adequately, in which additionally the internal DC resistance of the constituted real inductors Lreal91(*a,b,c*,etc.) can be compensated by lowering the calculated total resistance specified for the resistors R91(*a,b,c*,etc.), with the total resided internal DC resistance specified for the real inductors Lreal91(*a,b,c*,etc.) preserving extraction filter performance.

The constituted real capacitor Creal91 will serve alongside a filter component for low pass signal filtering as a passive integrator averaging the smoothed current derived from the real inductors Lreal91(*a,b,c*,etc.) and therefore extracting the employed high voltage pulse modulated signal provided at the input terminal IN91 in which the DC offset voltage if employed, the analogue AC signal voltage and the residual switching voltage will be superimposed across the real capacitor Creal91.

In order to obtain proper high frequency properties, it is required to implement a real capacitor Creal91 as illustrated in FIG. 20 showing a low equivalent series inductance (ESL) Lpar94 and a low equivalent series resistance (ESR) Rloss94. Needless to say, that the low ESR of a real capacitor consisting of for example the losses in the dielectric material and lead resistance will provide a high quality factor Q. In general the ESL will form a series resonant circuit with the capacitance of a real capacitor, in which the applicability of the real capacitor will be limited due to the introduced self-resonant frequency. In practice the introduced self-resonance frequency of the real capacitors Creal91 will be at a much higher frequency than the self-resonant frequency of the real inductors Lreal91(*a,b,c*,etc.), in which the parasitic series resonant circuit of the constituted real capacitor acts as a notch filter as well in the extraction filter 90 configuration. In order to enhance the high frequency properties the real capacitor Creal91 as illustrated in FIG. 20 may be employed for example as a single real capacitor provided with two input leads separated from two output leads (not shown), in which the common parasitic inductance Lpar91 and common loss resistance Rloss91 may be decreased to a common parasitic impedance value as small as physically possible.

It is to be noted that two or several real capacitors connected in series in stead of the single real capacitor Creal91 as illustrated in FIG. 20, splitting the calculated capacitance value for a single capacitor into higher capacitance valued real capacitors to achieve the same total capacitance value in order to meet the applicable voltage and loss requirements for the series connected real capacitors, may result in an increase of parasitic inductance deteriorating the high frequency characteristics. Furthermore a resistors network required in order to balance the voltages across the series connected real capacitors will introduce an undesired RC high pass cut-off frequency. As a result only a single real capacitor Creal91 as illustrated in FIG. 20 will be preferred, if necessary made on specification.

In the case two real capacitors are connected in parallel in stead of the single real capacitor Creal91 as illustrated in FIG. 20, splitting the calculated capacitance value for a single capacitor into lower capacitance valued real capacitors in order to achieve the same total capacitance value, one of the paralleled real capacitors may represent for example a feed through capacitor maintaining the separation between two shielded compartments, in which the signal path between the paralleled capacitors may be interrupted by means of for example a ferried bead forming a pi filter in order to obtain additional EMI suppression.

In the case for example a class-I ceramic capacitor represented of Creal91 as illustrated in FIG. 20 is employed showing a near perfect real capacitor, a predetermined temperature drift can be supplemented in order to compensate the temperature drift of other filter components preserving the characteristic filter properties.

It is to be emphasised that the ground reference (DGND) of a high voltage switching arrangement strictly separated from the analogue ground reference (AGND) will be coupled at a single connection point preferably at the ground reference connection of the real capacitor Creal91 as illustrated in FIG. 20.

As illustrated in FIG. 20 the real resistors R92(*a,b,c*,etc.) are series connected splitting the calculated resistance value for a single resistor into lower resistance valued real resistors to achieve the same total resistance value in order to meet the applicable voltage and loss requirements for the constituted real resistors.

The constituted real resistors R92(*a,b,c*,etc.) will serve as a constant high resistive impedance component over the desired operational bandwidth in order to damp, the residual switching frequency and the resonance frequencies of the resonant circuits constituted by the series connected real inductors Lreal91(*a,b,c*,etc.) in conjunction with the real capacitors Creal91 and C93 as described above providing a stable extraction filter.

Similarly to the real resistors R91(*a,b,c*,etc.), it is desired to implement the real resistors R92(*a,b,c*,etc.) as illustrated in FIG. 20 showing low parasitic capacitance, good impulse response as well as low noise properties, in which the parasitic inductance will be of less importance affecting filter performance. According to the overall design objectives of an implemented real resistor, a thick film resistor for example with an aluminium-oxide substrate may be selected, representing the real resistors R92(*a,b,c*,etc.).

It is to be noted, that in the case the capacitive load represented of capacitor C93 will be doubled, in which the filter components will be adapted as well, maintaining the characteristic filter properties, the pulse modulated high voltage signal, provided at input terminal IN91 resulting in an analogue high voltage signal swing across the capacitive load, may be halved in order to generate an equal amount of electrical charge resided in the capacitive load and subsequently will result in half the losses caused in the real resistors R91 (*a,b,c*,etc.) and R92(*a,b,c*,etc.).

As illustrated in FIG. 20 the real capacitors C92(*a,b,c*,etc.) are series connected splitting the calculated capacitance value for a single capacitor into higher capacitance valued real capacitors to achieve the same total capacitance value in order to meet the applicable voltage requirements for the constituted real capacitors.

The constituted real capacitors C92(*a,b,c*,etc.) will serve as a DC-blocking capacitor decoupling the DC-offset voltage component if employed of the high voltage pulse modulated signal provided at the input terminal IN91 with respect to the ground reference resulting in the analogue AC signal voltage and the residual switching voltage superimposed across the real capacitive load represented of C93 as shown in FIG. 20.

As illustrated in FIG. 20 the resistance network constituted of the very high resistance valued real resistors R93(*a,b,c*, etc.) implemented in order to balance the DC voltages across the relative high capacitance valued real capacitors C92(*a,b, c*,etc.) in which the resulting RC high pass cut-off frequency is at least an order of magnitude lower with respect to the RC high pass cut-off frequency constituted by means of the real capacitors C92(*a,b,c*,etc.) in conjunction with the high resistance valued real resistors R94(*a,b,c*,etc.) providing a ground referenced analogue AC signal voltage and residual switching voltage superimposed across the real capacitive load represented by capacitor C93.

It is to be noted that a constituted real capacitor for example C92*a* employed as a DC-blocking capacitor as illustrated in FIG. 20 shows in accordance with its function a relatively high capacitive value in the filter setting and subsequently resulting in decreased high frequency properties. Nonetheless in an alternative extraction filter embodiment one or several DC-blocking real capacitors in series may be placed even at the input of an extraction filter and therefore to the direct output of the high voltage switching output stage in order to obtain a proper working filter design.

In general the RC high pass cut-off frequency constituted by means of the real capacitors C92(*a,b,c*,etc.) in conjunction with real resistors R94(*a,b,c*,etc.) may provide for example a cross over filter matching subwoofer characteristics as well as mitigating the resonance frequency of the diaphragm resided in an electrostatic speaker element. According to the overall design objectives of a DC-blocking real capacitor representing the real DC-blocking capacitors C92(*a,b,c*,etc.), a metallized polypropylene film capacitor may be selected showing low dielectric losses.

It is to be noted that two or several real load capacitors may be connected in series as well as in parallel resulting in a total real capacitive load value represented of real capacitor C93 as illustrated in FIG. 20, in which the enclosed parasitic inductance and resistance will be of less importance affecting the filter performance as long as the proper ratios between the constituted capacitor and inductor values in conjunction with a proper damping resistance are set in the extraction filter setting as described above. Needless to say that the resulting total real capacitive load value may be defined as a capacitive reactance component predominating the impedance value over the operational bandwidth of interest wherein the capacitive reactance component is at least an order of magnitude higher valued with respect to the inductive reactance component as well as the resistance component.

Considering the input impedance of the band pass extraction filter 90 setting as illustrated in FIG. 20, the handled apparent power, required in order to drive the input impedance by means of a high voltage switching output stage in conjunction with a high voltage power supply, may consist of a predominant reactive power component over the active power component also called the real power component, provided that the AC operational power bandwidth is a defined part of for example 20 Hz to 22 kHz within the AC operational signal bandwidth. Subsequently the constituted inductor and capacitor components as illustrated in FIG. 20, acting as energy storage elements, provided with an alternating current flow by means of the high voltage pulse modulated signal presented at the input terminal IN91 will result in a periodic reversal of the direction of energy flow, in which a predetermined part of the delivered energy over a half cycle of the AC analogue signal waveform will be transferred back during the other half cycle into the high voltage power supply with the regulated intervention of a high voltage switching output stage showing the reactive power component of the apparent power. The active power component of the apparent power on the other hand will arise mainly due to the loss of electrical energy in the damping resistors R91(*a,b,c*,etc.) and R92(*a,b, c*,etc.) as illustrated in FIG. 20 as well as parasitic loss components as described above. It is to be noted, that the high voltage power supply only needs to supply the active power component of the apparent power wherein the energy of the reactive power component will be regenerated. Hence a highly alleviated power supply providing a less complex and very stable high voltage power supply with respect to for example an analogue high voltage amplifier design approach.

The high voltage output stage will generate high voltage block wave signals containing a large amount of spectral energy at the fundamental in conjunction with its harmonics, which results in a high electrical field component of the EMI and subsequently the susceptibility for capacitive coupling. In order to decrease capacitive coupling effects and therefore the EMI between the constituted components and its surroundings shielding may be implemented forming for example various compartments of metal with high electrical conductivity such as silvered copper or aluminium cascaded in a stacked form each residing a component group part of the extraction filter configuration as well as part of the high voltage switching arrangement, in which separation will be maintained channelling the EMI in a predetermined route in order to guarantee extraction filter performance and compliance with applicable regulations.

In a final disclosed exemplary embodiment, a sound projecting arrangement will be constituted of two electrostatic speakers each actively driven with an integrated high voltage switching amplifier. Subsequently each integrated high voltage switching amplifier may be provided with an analogue as well as a digital audio formatted signal as an input with additional control signals distributed for example by electrical wire, by fibre optics or by air emanated from a central base unit and more specific from a pre-amplifier. The central pre-amplifier may comprise various function blocks, such as for example an analogue to digital converter as well as a digital to analogue converter and furthermore one or several enclosed analogue as well as digital processing units in order to provide the capability of for example volume and tone control but also various audio settings for home cinema operating modes including multi-channel capability. In addition a central pre-amplifier may comprise a single power supply component as well supplying the power by means of electrical wire to each integrated sub unit and more specific to a high voltage switching amplifier integrated in each electrostatic speaker. Needless to say, that a high voltage switching amplifier by itself may comprise the various function blocks as well, defined for a pre-amplifier as described above.

Although the invention has been explained towards the driving capability of the capacitive load resided in an electrostatic speaker element by means of a high voltage switching power amplifier with additional features, similar embodiments are suitable wherein a capacitive load can be driven with the advantages of the high voltage switching topologies in conjunction with an extraction filter as disclosed above. It is to be noted, that the methods, circuits, equations and components exhibited in the present invention with reference to the enclosed exemplary embodiments, are presented for purpose of illustration and description only, in which the precise forms disclosed are not intended to be exhaustive or to be limited. It is to be emphasised, that the invention for the functions specified may be implemented by means of hardware as well as software, in which both hardware and software means may interrelate in one or several equivalent items as disclosed in the present invention. Subsequently it will be apparent to those skilled in the art that the spirit and scope of the present invention resides not only in any novel feature taken alone, but rather in the particular combination of all of its structures as well as all of its interrelationships for the functions specified.

The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

The invention claimed is:

1. An electrostatic speaker system comprising a high voltage switching power amplifier having at least one high voltage switching output stage (100);

an extraction filter (102) having an input coupled to an output of the at least one high voltage switching output stage (100); and an electrostatic speaker element having a capacitive load (104), wherein the capacitive load forms a part of the extraction filter (102), the capacitive load being connected to an output of the extraction filter, the extraction filter having at least a first low pass filter stage (106) connected in series with a second low pass filter stage (108), the first filter stage comprising a RLC circuit having a resonant frequency ω0 and a quality factor Q>½ and the second filter stage having at least one electrical element for damping a signal component at the resonant frequency of the RLC circuit at the output of the extraction filter (102).

2. An electrostatic speaker system according to claim 1, wherein the extraction filter is a single ended low pass Nth order filter, N being an integer larger than or equal to three.

3. An electrostatic speaker system according to claim 1, wherein the first filter stage comprises a series connection of a first stage resistor, a first stage inductor and a first stage capacitor, the series connection connected between a first filter stage input and a ground node, and wherein the second filter stage comprises a series connection of a second stage resistor and a second stage capacitor, connected between a second filter stage input and a ground node.

4. An electrostatic speaker system according to claim 3, wherein a node between the second stage resistor and second stage capacitor is coupled to an output of the second filter stage, the output of the second filter stage is coupled to the input of the first filter stage and the capacitive load is the first stage capacitor.

5. An electrostatic speaker system according to claim 3, wherein a node between the first filter stage inductor and first stage capacitor is coupled to an output of the first filter stage, the output of the first stage is coupled to the input of the second filter stage and the capacitive load is the second stage capacitor.

6. An electrostatic speaker system according to claim 5, wherein the resistance value of the second stage resistor is defined by the following equation:

$$R_{42} = \sqrt{\frac{L_{41}}{C_{41}}}$$

wherein $R_{42}$=the resistor value of the second stage resistor, $C_{41}$=the capacitance value of the first stage capacitor, and $L_{41}$=the inductance value of the first stage inductor, and the capacitance value of the first stage capacitor is defined by the following equation:

$$C_{42}(1+\sqrt{3})C_{41}$$

wherein $C_{42}$=the capacitance value of the second stage capacitor, and wherein the relation between the resistance value of the first stage resistor and a quality factor Q is defined by the following equation:

$$R_{41} = \left(\frac{1}{Q} - \sqrt{2}\right)\sqrt{\frac{L_{41}}{C_{41} + C_{42}}} \left\{Q \le \frac{1}{\sqrt{2}}\right\}$$

wherein $R_{41}$=the resistor value of the first stage resistor, and Q=the quality factor of the filter setting.

7. An electrostatic speaker system according to claim 5, wherein the second filter stage includes a second stage inductor connected between the second stage resistor and second stage capacitor.

8. An electrostatic speaker system according to claim 7, wherein the resistance value of the second stage resistor is defined by the following equation:

$$R_{62} = \sqrt{\frac{L_{61}}{C_{61}} + \frac{\left(4 - \frac{1}{Q_{62}^2}\right)L_{62}}{C_s}} \quad \left\{\frac{1}{2} < Q_{62}\right\}$$

wherein $$C_s = \frac{C_{61}C_{62}}{C_{61} + C_{62}},$$

and $R_{62}$=the resistor value of the second stage resistor, and $Q_{62}$=the second quality factor of the filter setting, and wherein the ratios of the capacitance values of the first stage capacitor and the second stage capacitor and the inductance values of the first stage inductor and the second stage inductor are expressed in the ratio factors n and m and are defined by the following equations:

$C_{62}=nC_{61}$ and $L_{61}=nmL_{62}$ and wherein the relation between n and m are defined by the equation:

$$\frac{\sqrt{2}}{\sqrt{\frac{nmL_{62}}{C_{61}}+\frac{\left(4-\frac{1}{Q_{62}^2}\right)L_{62}}{\frac{C_{61}nC_{61}}{C_{61}+nC_{61}}}nC_{61}}}=\frac{1}{\sqrt{nmL_{62}\left(\frac{C_{61}+}{nC_{61}}\right)+L_{62}nC_{61}}}$$

$$\text{wherein}\left\{\frac{1}{2}<Q_{62},\ 0<m\right\},$$

wherein $C_{61}$=the capacitance value of the first stage capacitor, $C_{62}$=the capacitance value of the second stage capacitor, $L_{61}$=the inductance value of the first stage inductor, $L_{62}$=the inductance value of the second stage inductor, n and m>0 and $Q_{62}>½$, and wherein the relation between the resistance value of the first stage resistor and the first quality factor of the filter setting is defined by the following equation:

$$R_{61}=\left(\frac{1}{Q_{61}}-\sqrt{2}\right)\sqrt{\frac{L_{61}}{C_{61}+C_{62}}+\frac{L_{62}}{C_{62}}}\left(Q_{61}=Q_{62},\ Q_{61}\leq\frac{1}{\sqrt{2}}\right)$$

wherein $R_{61}$=the resistor value of the first stage resistor, and $Q_{61}$=the first quality factor of the filter setting.

9. An electrostatic speaker system according to claim 7, wherein the second filter stage comprises a further second stage capacitor parallel connected to the second stage inductor.

10. An electrostatic speaker system according to claim 1, wherein the series connection of the second filter stage comprises a second stage inductor (L82), wherein the electrostatic speaker system further comprises M further second filter stages connected parallel to the second filter stage, wherein each of the M further second filter stages comprises a series connection of a further second stage resistor and a further electrostatic speaker element, M being an integer larger than or equal to one.

11. An electrostatic speaker system according to claim 1, wherein the extraction filter is a differential low pass Nth order filter, N being an integer larger than or equal to three.

12. An electrostatic speaker system according to claim 11, wherein the first filter stage comprises a series connection of a first first stage resistor (R34*a*, R73*a*), a first first stage inductor (L32*a*, L73*a*), a first stage capacitor (C35, C74), a second first stage inductor (L32*b*, L73*b*) and a second first stage resistor (R34*b*, R73*b*), the series connection connected between a first first filter stage terminal (IN72*a*) and a second first filter stage terminal (IN72*b*), the second filter stage comprises a series connection of a first second stage resistor (R33*a*, R74*a*), a second stage capacitor (C33, C75) and a second second stage resistor (R33*b*, R74*b*), the series connection connected between a first second filter stage terminal (IN32*a*) and a second second filter stage terminal (IN32*b*), and the electrostatic speaker element is the first stage capacitor (C35) or the second stage capacitor (C75).

13. An electrostatic speaker system according to claim 12, wherein a node between the first second stage resistor (R33*a*) and the second stage capacitor (C33) is coupled to a first output node of the second filter stage and a node between the second second stage resistor (R33*b*) and second stage capacitor (C33) is coupled to a second output node of the second filter stage, the first output node is coupled to the first first filter stage terminal and the second output node is coupled to the second first filter stage terminal and the capacitive load is the first stage capacitor (C35).

14. An electrostatic speaker system according to claim 12, wherein a node between the first first stage inductor (L73*a*) and first stage capacitor (C74) is coupled to a first output node of the first filter stage and a node between the second first stage inductor (L73*b*) and first stage capacitor (C74) is coupled to a second output node of the first filter stage, the first output node is coupled to the first second filter stage terminal and the second output node is coupled to the second second filter stage terminal and the capacitive load is the second stage capacitor (C75).

15. An electrostatic speaker system according to claim 14, wherein the series connection of the second filter stage comprises a parallel connection of a first second stage inductor (L74*a*) and a first second stage capacitor (C76*a*) and a parallel connection of a second second stage inductor (L74*b*) and a second further second stage capacitor (C76*b*).

16. An electrostatic speaker system according to claim 15, wherein the series connection of the second filter stage includes a first second stage inductor (L84*a*) and a second second stage inductor (L84*b*), wherein the electrostatic speaker system further comprises M further second filter stages connected parallel to the second filter stage, wherein each of the M further second filter stages comprises a series connection of a first further second stage resistor (R86*a*A), a further electrostatic speaker element (C86A) and a second further second stage resistor (R86*b*A), M being an integer larger than or equal to one.

17. An electrostatic speaker system according to claim 1, wherein the extraction filter comprises a DC blocking capacitor.

18. An extraction filter for use in an electrostatic speaker system comprising all technical features of a first filter stage (106) and a second filter stage (108) according to claim 1.

19. A method for driving an electrostatic speaker element of an electrostatic speaker system comprising:

receiving an audio formatted input signal representing an analogue source signal, the audio formatted input signal being provided at an input of a high voltage switching power amplifier;

generating a high voltage pulse modulated output signal provided at an output of a high voltage switching output stage (100);

extracting the high voltage pulse modulated output signal in order to reconstruct an amplified analogue output signal as a proportional replica of the analogue source signal, the amplified analogue output signal being provided at an output of an extraction filter, wherein a capacitive load of the electrostatic speaker element forms a part of the extraction filter, the capacitive load being connected to the output of the extraction filter, the extraction filter having at least a first low pass filter stage (106) connected in series with a second low pass filter stage (108), the first filter stage comprising a RLC circuit having a resonant frequency w0 and a quality factor Q>½ and the second filter stage having at least one electrical element for damping a signal component at the resonant frequency of the RLC circuit at the output of the extraction filter (102).

20. A method according to claim 19, further comprising:

segmenting the electrostatic speaker element in M plus one electrically filter segments for adapting the electrostatic speaker element acoustically, each one of the M plus one segments having a characteristic capacitive load being a part of the extraction filter for tuning a cut-off frequency of each one of the M further segments defined within an initial operational bandwidth of a first segment, M being an integer larger than or equal to one.

21. A method according to claim 19, further comprising;

implementing at least one resonant filter in the extraction filter for blocking a fundamental, as well as, several other frequency components of the high voltage pulse modulated signal and decreasing residual switching energy from being dissipated, implementing a high pass filter providing a band pass extraction filter having at least one DC blocking capacitor for decoupling a DC offset voltage component and providing a RC high pass cut-off frequency.

22. A method according to claim 19, wherein the extraction filter is a single ended filter employing a half bridge switching topology.

23. A method according to claim 19, wherein the extraction filter is a differential filter employing a full bridge switching topology.

* * * * *